US009147567B2

(12) United States Patent
Loboda

(10) Patent No.: US 9,147,567 B2
(45) Date of Patent: Sep. 29, 2015

(54) METHOD AND APPARATUS FOR IMPROVED SENSITIVITY IN A MASS SPECTROMETER

(71) Applicant: DH Technologies Development Pte. Ltd.

(72) Inventor: Alexandre V. Loboda, Thornhill (CA)

(73) Assignee: DH Technologies Development Pte. Ltd. (SG)

( * ) Notice: Subject to any disclaimer, the term of this patent is extended or adjusted under 35 U.S.C. 154(b) by 0 days.

(21) Appl. No.: 14/375,489

(22) PCT Filed: Feb. 1, 2013

(86) PCT No.: PCT/IB2013/000131
§ 371 (c)(1),
(2) Date: Jul. 30, 2014

(87) PCT Pub. No.: WO2013/114191
PCT Pub. Date: Aug. 8, 2013

(65) Prior Publication Data

US 2015/0008320 A1 Jan. 8, 2015

Related U.S. Application Data

(60) Provisional application No. 61/593,717, filed on Feb. 1, 2012.

(51) Int. Cl.

| | |
|---|---|
| ***H01J 49/26*** | (2006.01) |
| ***H01J 49/06*** | (2006.01) |
| ***H01J 49/10*** | (2006.01) |
| ***H01J 49/24*** | (2006.01) |
| ***H01J 49/36*** | (2006.01) |

(52) U.S. Cl.
CPC ..... *H01J 49/063* (2013.01); *H01J 49/10* (2013.01); *H01J 49/24* (2013.01); *H01J 49/36* (2013.01)

(58) Field of Classification Search
USPC ..... 250/281, 282, 283, 288
See application file for complete search history.

(56) References Cited

U.S. PATENT DOCUMENTS

| | | | | |
|---|---|---|---|---|
| 6,730,904 | B1 | 5/2004 | Wells | |
| 2006/0108520 | A1* | 5/2006 | Park et al. | 250/287 |
| 2006/0169891 | A1 | 8/2006 | Collings et al. | |
| 2009/0159791 | A1 | 6/2009 | Wells | |
| 2009/0294662 | A1* | 12/2009 | Belov et al. | 250/291 |
| 2010/0090102 | A1 | 4/2010 | Rather et al. | |
| 2010/0171035 | A1 | 7/2010 | Okumura et al. | |
| 2012/0261570 | A1* | 10/2012 | Shvartsburg et al. | 250/287 |
| 2014/0374589 | A1* | 12/2014 | Javaheri et al. | 250/282 |

OTHER PUBLICATIONS

International Search Report from International Patent Application No. PCT/IB2013/000131, dated Jun. 27, 2013.

* cited by examiner

*Primary Examiner* — Nicole Ippolito

(57) ABSTRACT

An ion source and an ion guide chamber are provided. The ion guide chamber having a gas flow, the gas flow having a longitudinal velocity and a transverse velocity. The ion guide chamber having an exit aperture and at least one ion guide. The at least one ion guide having an entrance end and an exit end with an exit cross-section wherein the exit cross-section is sized to be smaller in area than the entrance cross-section. The at least one ion guide having a plurality of elongated electrodes wherein a gap between the elongated electrodes and the shape of the elongated electrodes in the vicinity of the gap are essentially the same along the length of the at least one ion guide for confining the ions in the vicinity of the gap by a combination of the transverse velocity of the gas and the RF voltage.

20 Claims, 36 Drawing Sheets

METHOD AND APPARATUS FOR IMPROVED SENSITIVITY IN A MASS SPECTROMETER

RELATED APPLICATION

This application claims priority to U.S. provisional application No. 61/593,717 filed Feb. 1, 2012, which is incorporated herein by reference in its entirety.

FIELD

The applicant's teachings relate to a method and apparatus for improved sensitivity in a mass spectrometer, and more specifically to ion guides for transporting ions.

INTRODUCTION

In mass spectrometry, sample molecules are converted into ions using an ion source, in an ionization step, and then detected by a mass analyzer, in mass separation and detection steps. For most atmospheric pressure ion sources, ions pass through an inlet aperture prior to entering an ion guide in a vacuum chamber. The ion guide transports and focuses ions from the ion source into a subsequent vacuum chamber, and a radio frequency voltage can be applied to the ion guide to provide radial focusing of ions within the ion guide. However, during transportation of the ions through the ion guide, ion losses can occur. Therefore, it is desirable to increase transport efficiency of the ions along the ion guide and prevent the loss of ions during transportation to attain high sensitivity. It is also desirable to increase gas flow handling capacity of the ion guide which can lead to improved sensitivity. For some ion sources an increase in the gas flow would bring with it more ions and more gas. However, only some ion guides such as those described here would be able to handle the higher gas flow without the loss of the ions. Sometimes, too high a gas flow can overwhelm and destroy the functioning of the ion guide. Furthermore, the optimal gas flow and the optimal ion guide to handle the gas flow can be different for different applications since different ion sources can generate different amounts of gas flow. For example, a nanospray ion source can produce lower gas flow than an ESI source. Thus, there also exists a need for ion guides that can handle higher gas flows without losing ions.

SUMMARY

In view of the foregoing, the applicant's teachings provide a mass spectrometer apparatus. In various aspects, the apparatus comprises an ion source for generating a beam of ions from a sample and an ion guide chamber for receiving the ions from the ion source. In various embodiments, one or more inlet apertures can be provided. In various aspects, an array of smaller inlet apertures can be provided. In various aspects, the ions are entrained in a gas flow, the gas flow having a longitudinal velocity and a transverse velocity. In various aspects, the apparatus also comprises an exit aperture for passing ions from the ion guide chamber. In various aspects, the at least one ion guide can be located in the ion guide chamber, and the at least one ion guide can have an entrance end and a predetermined entrance cross-section defining an internal volume. In various aspects, the at least one ion guide can have an exit end and an exit cross-section wherein the exit cross-section is sized to be smaller in area than the entrance cross-section. In various aspects, a power supply can provide an RF voltage to the at least one ion guide. In various aspects, the at least one ion guide can comprise at least one multipole ion guide having a plurality of elongated electrodes wherein a gap between the elongated electrodes and the shape of the elongated electrodes in the vicinity of or near the gap can be essentially the same along the length of the at least one ion guide for confining the ions in the vicinity of the gap by a combination of the gas drag due to transverse velocity of the gas and the RF voltage.

A method of transmitting ions is also provided. In various aspects, the method comprises generating a beam of ions, providing an ion guide chamber for receiving the ions from the ion source. In various embodiments, one or more inlet apertures can be provided. In various aspects, an array of smaller inlet apertures can be provided. In various embodiments, multiple ions sources can supply ions simultaneously. In various embodiments, different ion sources can supply ions through different apertures in an array of apertures. In various aspects, the ions are entrained in a gas flow, the gas flow having a longitudinal velocity and a transverse velocity. In various aspects, an exit aperture can be provided for passing the ions from the ion guide chamber. In various aspects, the method comprises providing at least one ion guide located in the ion guide chamber, the at least one ion guide having a predetermined cross-section defining an internal volume. In various aspects, the at least one ion guide can have an exit end and an exit cross-section wherein the exit cross-section is sized to be smaller in area than the entrance cross-section. In various aspects, the method comprises applying an RF voltage to the at least one ion guide. In various aspects, the at least one ion guide can comprise at least one multipole ion guide having a plurality of elongated electrodes wherein a gap between the elongated electrodes and the shape of the elongated electrodes in the vicinity of or near the gap are essentially the same along the length of the at least one ion guide for confining the ions in the vicinity of the gap by a combination of the gas drag due to the transverse velocity of the gas and the RF voltage.

In various aspects, a mass spectrometer is provided comprising an ion source for generating a beam of ions from a sample in a high pressure region, and a first vacuum chamber comprising an inlet aperture for passing the ions from the high-pressure region into the vacuum chamber. In various embodiments, one or more inlet apertures can be provided. In various aspects, an array of smaller inlet apertures can be provided. In various aspects, an exit aperture is provided for passing the ions from the vacuum chamber. In various aspects, the mass spectrometer comprises a gas dynamic ion transfer device at the exit aperture of the first vacuum chamber, the gas dynamic ion transfer device can have an inlet end and an outlet end wherein the ions pass through the inlet end and exit through the outlet end of the gas dynamic ion transfer device. In various aspects, the mass spectrometer can have a power supply for providing an RF voltage to the at least one ion guide for radially confining the ions within the internal volume of the at least one ion guide.

In various aspects, a method of transmitting ions is provided. The method comprises generating a beam of ions from a sample in a high pressure region, and providing a first vacuum chamber comprising an inlet aperture for passing the ions from the high-pressure region into the vacuum chamber. The method can further comprise an exit aperture for passing the ions from the vacuum chamber, and at least one ion guide between the inlet and exit apertures, the at least one ion guide having an entrance end and a predetermined entrance cross-section defining an internal volume. The method can comprise providing a gas dynamic ion transfer device at the exit aperture of the first vacuum chamber, the gas dynamic ion transfer device can have an inlet end and an outlet end wherein the ions pass through the inlet end and exit through the outlet end of the gas dynamic ion transfer device. The method can comprise providing a power supply for providing an RF voltage to the at least one ion guide for radially confining the ions within the internal volume of the at least one ion guide.

In various aspects, a mass spectrometer is provided comprising an ion source for generating a beam of ions from a sample in a high pressure region, and a vacuum chamber comprising an inlet aperture for passing the ions from the high-pressure region into the vacuum chamber. In various embodiments, one or more inlet apertures can be provided. In various aspects, an array of smaller inlet apertures can be provided. In various aspects, an exit aperture can be provided for passing the ions from the vacuum chamber. In various aspects, at least one planar RF ion guide can be provided between the inlet and exit apertures, the at least one planar RF ion guide having a first end and a second end, and the at least one planar RF ion guide further having an array of RF elements. In various aspects, a power supply can provide an RF voltage to the array of RF elements wherein adjacent RF elements are each connected to opposite phases of the RF voltage. In various aspects, a power supply can provide voltage to the array of RF elements for directing the ions towards the second end of the at least one planar RF ion guide.

In various aspects, a method of transmitting ions is provided comprising providing an ion source for generating a beam of ions from a sample in a high pressure region, and providing a vacuum chamber comprising an inlet aperture for passing the ions from the high-pressure region into the vacuum chamber. In various embodiments, one or more inlet apertures can be provided. In various aspects, an array of smaller inlet apertures can be provided. In various aspects, the method comprises providing an exit aperture for passing the ions from the vacuum chamber and providing at least one planar RF ion guide between the inlet and exit apertures, the at least one planar RF ion guide having a first end and a second end, the at least one planar RF ion guide further having an array of RF elements. In various aspects, the method comprises providing a power supply for providing an RF voltage to the array of RF elements wherein adjacent RF elements are each connected to opposite phases of the RF voltage, and providing a power supply for providing DC voltage to the array of RF elements for directing the ions towards the second end of the at least one planar RF ion guide.

These and other features of the applicant's teachings are set forth herein.

BRIEF DESCRIPTION OF THE DRAWINGS

The skilled person in the art will understand that the drawings, described below, are for illustration purposes only. The drawings are not intended to limit the scope of the applicant's teachings in any way.

In the drawings, like reference numerals indicate like parts.

DESCRIPTION OF VARIOUS EMBODIMENTS

Ion transfer efficiency of atmospheric pressure ionization (API) sources can directly influence the sensitivity of mass spectrometers. To improve ion transfer efficiency, the size of the inlet aperture can be increased. However, a larger inlet aperture can lead to higher gas flow entering the mass spectrometer necessitating separation of ions from the gas flow. RF ion guides can be used to transport and confine ions and assist in handling the gas flow. Ion guides can provide focusing of ions to a central axis so they can be easily sampled through an aperture to the next stage of differential pumping. However, some ion guides may not focus ions to a spot, but instead can spread the ion beam as a ring or a line wherein ion losses can occur. Therefore, it is desirable to increase transport and focusing efficiency of the ions along the ion guide and prevent the loss of ions during transportation to attain high sensitivity.

Figure 1:
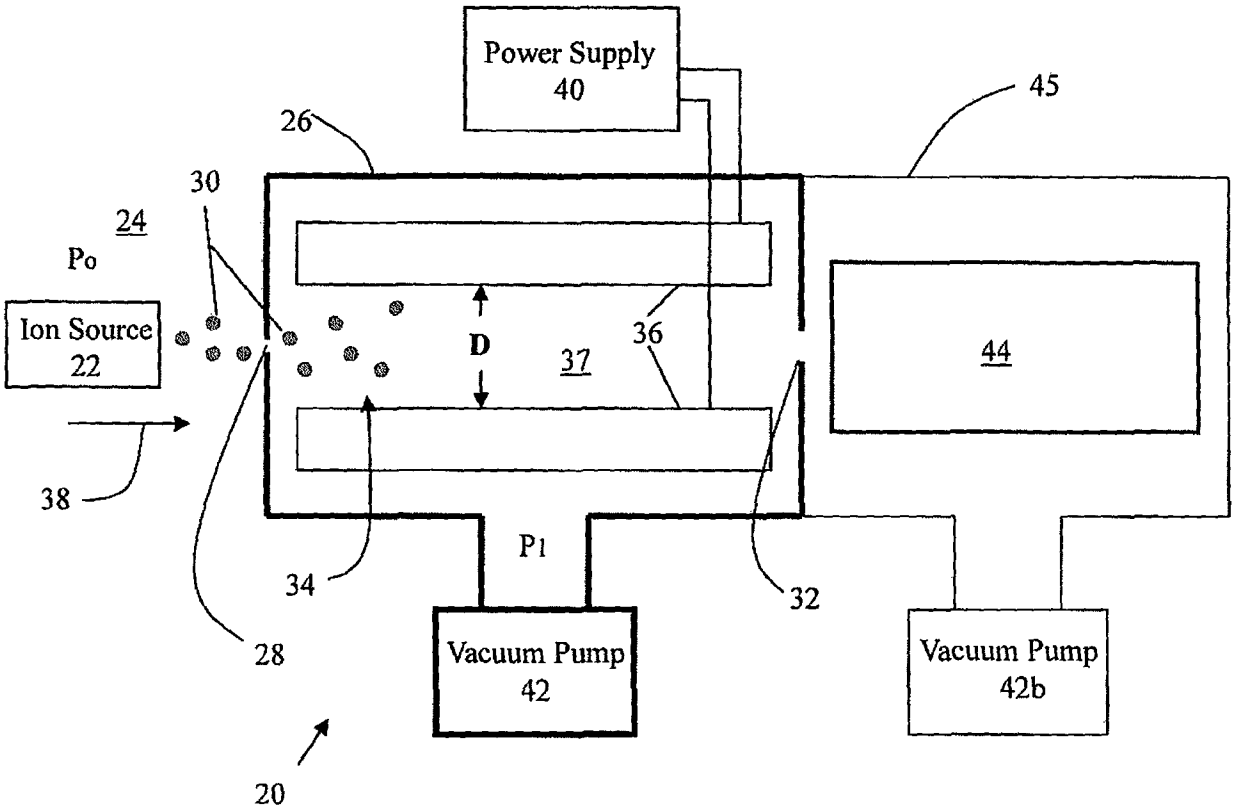
FIG. 1 is a schematic view of a mass spectrometry system according to various embodiments of the applicant's teachings.

Accordingly, a method and apparatus for performing mass analysis is provided. It should be understood that the phrase "a" or "an" used in conjunction with the applicant's teachings with reference to various elements encompasses "one or more" or "at least one" unless the context clearly indicates otherwise. Reference is first made to FIG. 1, which shows schematically a mass spectrometer, generally indicated by reference number 20. In various aspects, the mass spectrometer 20 comprises an ion source 22 for generating a beam of ions 30 from a sample of interest, not shown, in a pressure region $P_0$. In various embodiments, the ion source 22 can be positioned in the pressure P0 region containing a background gas (not shown), generally indicated at 24, while the ions 30 travel towards an ion guide chamber 26, in the direction indicated by the arrow 38. In various embodiments, the ion source 22 can be part of the ion guide chamber. In various aspects, the ion guide chamber 26 can receive the ions 30 from the ion source 22. In various aspects, the ions can enter the chamber 26 through an inlet aperture 28. In various embodiments, one or more inlet apertures can be provided. In various aspects, an array of smaller inlet apertures can be provided. In various aspects, the array of smaller inlet apertures can be circular or elongated. In various embodiments, the total area of the array of smaller apertures can be comparable to the total area of a single inlet aperture that has a diameter between about 0.1 mm and about 5 mm. In various aspects, the array of smaller inlet apertures can be arranged in any suitable pattern depending on the requirements of the ion source. For example, the array of smaller orifices can be arranged in, but is not limited to, a circular, square, hexagonal, or linear pattern. In various embodiments, the inlet aperture can be circular and can have a diameter between about 0.1 and about 5 mm. In various aspects, the circular inlet aperture can comprise a diameter of about 2 mm.

In various aspects, the pressure P1 in the ion guide chamber 26 can be maintained by a vacuum pump 42. In various embodiments, the ion guide chamber can have a pressure between about 0.1 and about 100 torr. In various aspects, the ion guide chamber 26 can have a pressure of about 10 torr. In various embodiments, the ion guide chamber 26 can have a gas flow wherein the ions are entrained in the gas flow. In various aspects, the gas flow can have a longitudinal velocity and a transverse velocity. In various aspects, the ion guide chamber 26 further comprises an exit aperture 32 located downstream from the inlet aperture 28 and at least one ion guide 36 can be located in the ion guide chamber 26 for radially confining, focusing and transmitting the ions 30. In various embodiments, the at least one ion guide 26 can be located in the ion guide chamber 26. In various aspects, the at least one ion guide 36 can have an entrance end and a predetermined entrance cross-section defining an internal volume 37. In various aspects, the predetermined cross-section can form an inscribed circle, with a diameter as indicated by reference letter D, and can have a diameter between about 1 and about 15 mm.

Figure 2:
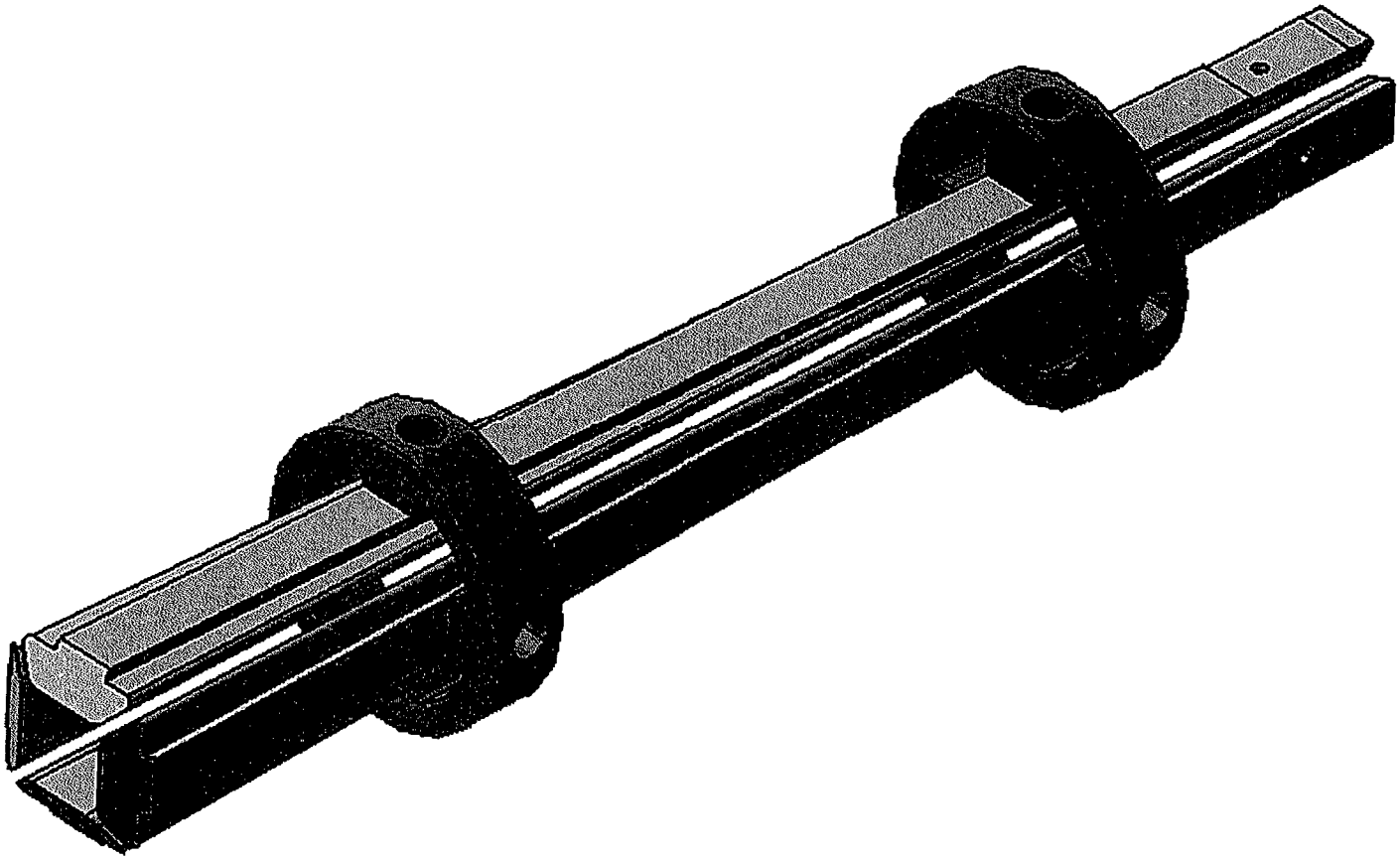
FIG. 2 is a three dimensional view of an ion guide according to various embodiments of the applicant's teachings.

In various aspects, the at least one ion guide can have an exit end and an exit cross-section wherein the exit cross-section can be sized to be smaller in area than the entrance cross-section. In various embodiments, the at least one multipole ion guide 36 is exemplified in FIGS. 2 and 3 which show, for example, a tapered quadrupole ion guide and the electrode shape of the tapered ion guide. In various embodiments, the at least one multipole ion guide 36 can comprise any number of poles, for example, but not limited to, 36-pole, 108-pole, etc. In various embodiments, the at least one ion guide can be tapered. In various aspects, a power supply 40 can be connected to the at least one ion guide 36 to provide RF voltage in a known manner. In various embodiments, multiple phases of RF can be provided. In various aspects, the at least one ion guide can comprise at least one multipole ion guide having a plurality of elongated electrodes wherein a gap between the elongated electrodes and the shape of the elongated electrodes in the vicinity of or near the gap are essentially the same along the length of the at least one ion guide for confining the ions in the vicinity of the gap by a combination of the gas drag due to the transverse velocity of the gas and the RF voltage.

In various embodiments, the gap between the elongated electrodes comprises between about 0.001 mm and about 5 mm. In various aspects, the entrance end of the at least one ion guide can be sized to capture the entire ion beam. In various aspects, the elongated electrodes comprise a planar portion and wherein the width of the planar portion is reduced to zero towards the exit end of the at least one ion guide. In various embodiments, the length of the elongated electrodes can be between about 1 cm to about 300 cm. In various embodiments, the mass spectrometer further comprises a mesh covering a planar portion of the elongated electrodes and a gas conduit for providing buffer gas for flowing through the mesh into the ion guide. In various aspects, the planar portion can comprise one of either a convex and a concave surface. In various aspects, the mass spectrometer can further comprise a gas dynamic ion transfer device. In various embodiments, the at least one multipole ion guide is selected from a quadrupole ion guide having four elongated electrodes, a hexapole ion guide having six elongated electrodes, and an octapole ion guide having eight elongated electrodes, a dodecople having 12 electrodes, an 18-pole ion guide, a 36-pole ion guide, a 54-pole ion guide, a 72-pole ion guide, a 108-pole ion guide and any combination thereof. In various embodiments, the at least one multipole ion guide can comprise any suitable number of poles.

In various embodiments, the exit aperture 32 in FIG. 1 is shown as the inter-chamber aperture separating the ion guide chamber 26 from the next or second chamber 45 that may house additional ion guides or a mass analyzer 44. Typical mass analyzers 44 can include quadrupole mass analyzers, ion trap mass analyzers, including linear ion trap mass analyzers, and time-of-flight mass analyzers. In various aspects, the pressure of the second chamber 45 can be maintained by a vacuum pump 42*b*. In various aspects, the at least one ion guide comprises a first ion guide followed by a second ion guide wherein the diameter of the entrance end of the second ion guide is smaller than the diameter of the exit end of the first ion guide. In various embodiments, the diameter of the second ion guide can be about 4 mm at an entrance end and about 1 mm at an exit end. In various aspects, the first and second ion guides can be selected from a quadrupole ion guide having four elongated electrodes, a hexapole ion guide having six elongated electrodes, and an octapole ion guide having eight elongated electrodes, a dodecople having 12 electrodes, an 18-pole ion guide, a 36-pole ion guide, a 54-pole ion guide, a 72-pole ion guide, a 108-pole ion guide and any combination thereof. In various embodiments, the at least one multipole ion guide can comprise any suitable number of poles. In various embodiments, the first and second ion guides can be in separate differentially pumped vacuum chambers. In various embodiments, a gas dynamic ion transfer device can connect the first and second ion guides. In various aspects, the at least one ion guide can comprise a series of multipole ion guides.

Figure 3:
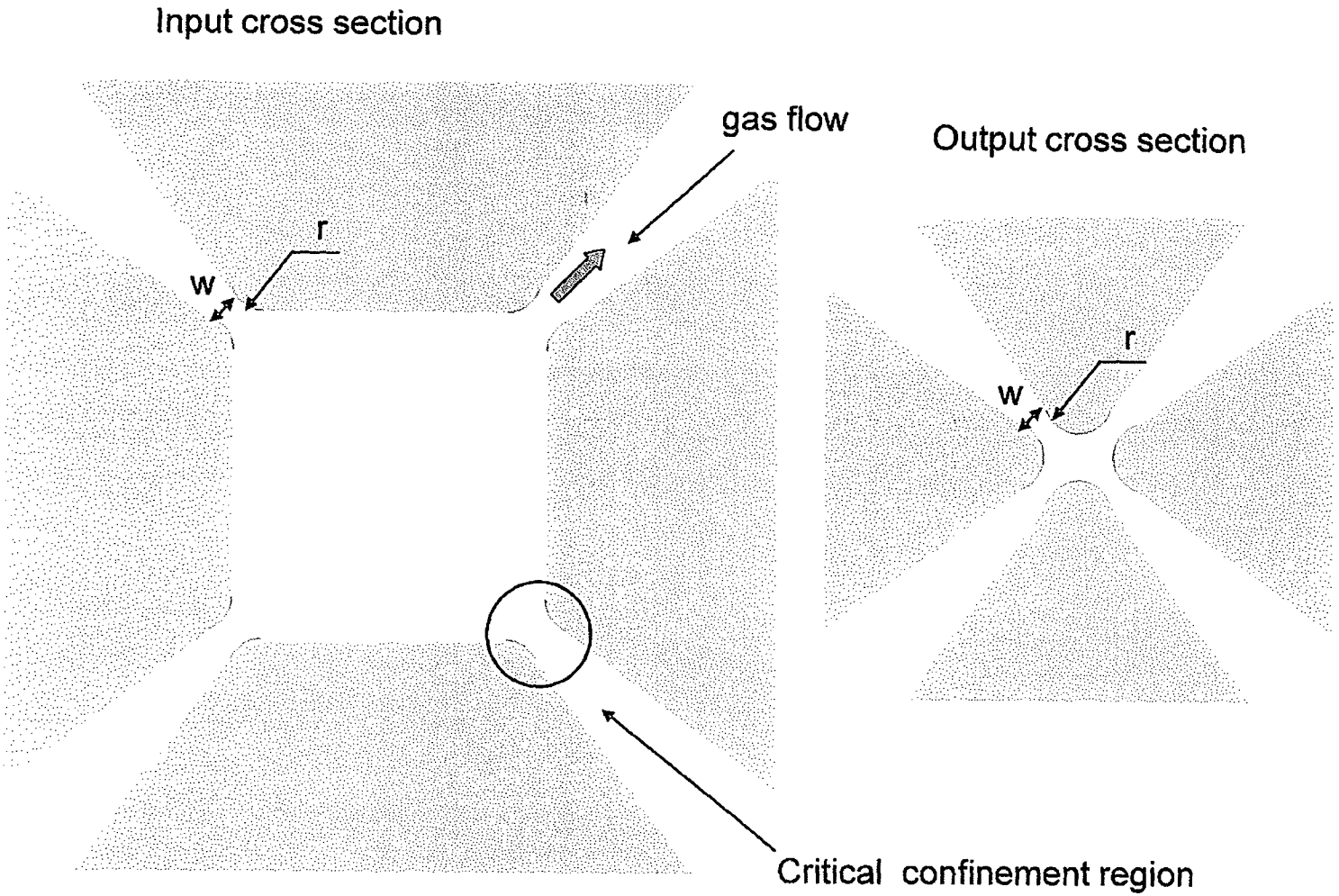
FIG. 3 is a schematic view of an ion guide according to various embodiments of the applicant's teachings.
Figure 4:
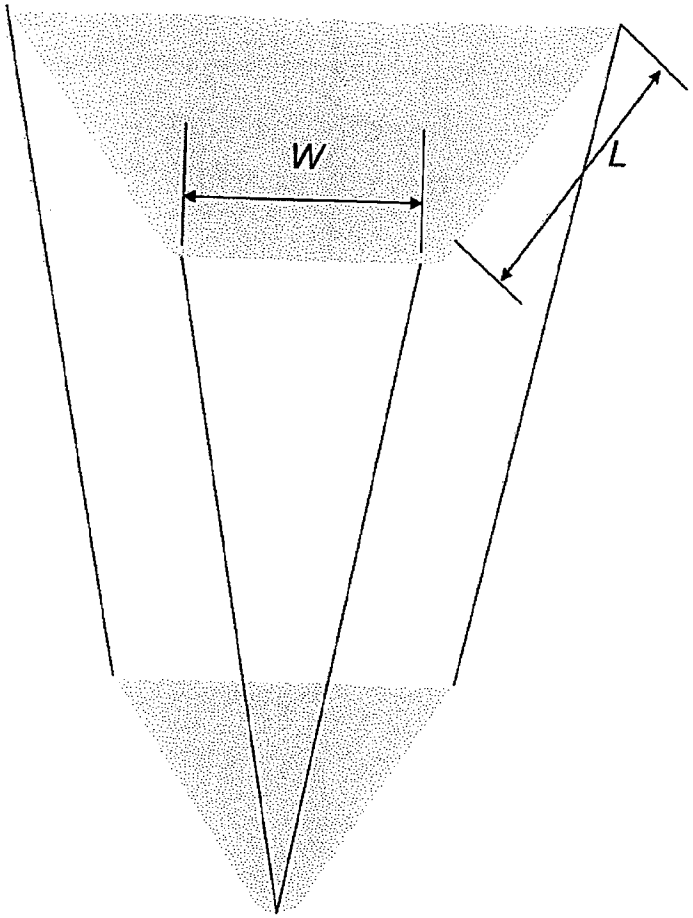
FIG. 4 is a schematic view of an ion guide according to various embodiments of the applicant's teachings.

Reference is made to FIG. 3 which exemplifies the at least one ion guide according to various embodiments of the applicant's teachings. For example, input and output cross sections of a quadrupole ion guide are shown in FIG. 3. An area where ion confinement is critical is outlined by a circle. In this region, the gas flow shown by an arrow, in a similar region, is dragging the ions away from the core of the ion guide. The only force that can prevent ions from being sucked into the vacuum system here is the pseudo-potential force generated due to the non-uniform RF field. The strength of the pseudo-potential force is controlled mainly by the gap or spacing between the electrodes (w) and the shape of the electrodes (r) in the critical confinement region. If the critical dimensions w, r are maintained essentially the same along the length of the at least one ion guide, the ion confinement in the critical confinement region can remain the same along the length of the ion guide. The principle of this ion confinement can be visualized by the ion guide having seams where the gas flow passes through. If the seams are "plugged" by RF pseudo-potential force the ions will be contained inside the ion guide. In various aspects, higher order multipole ion guides can be constructed using a similar principle.

Figure 5:
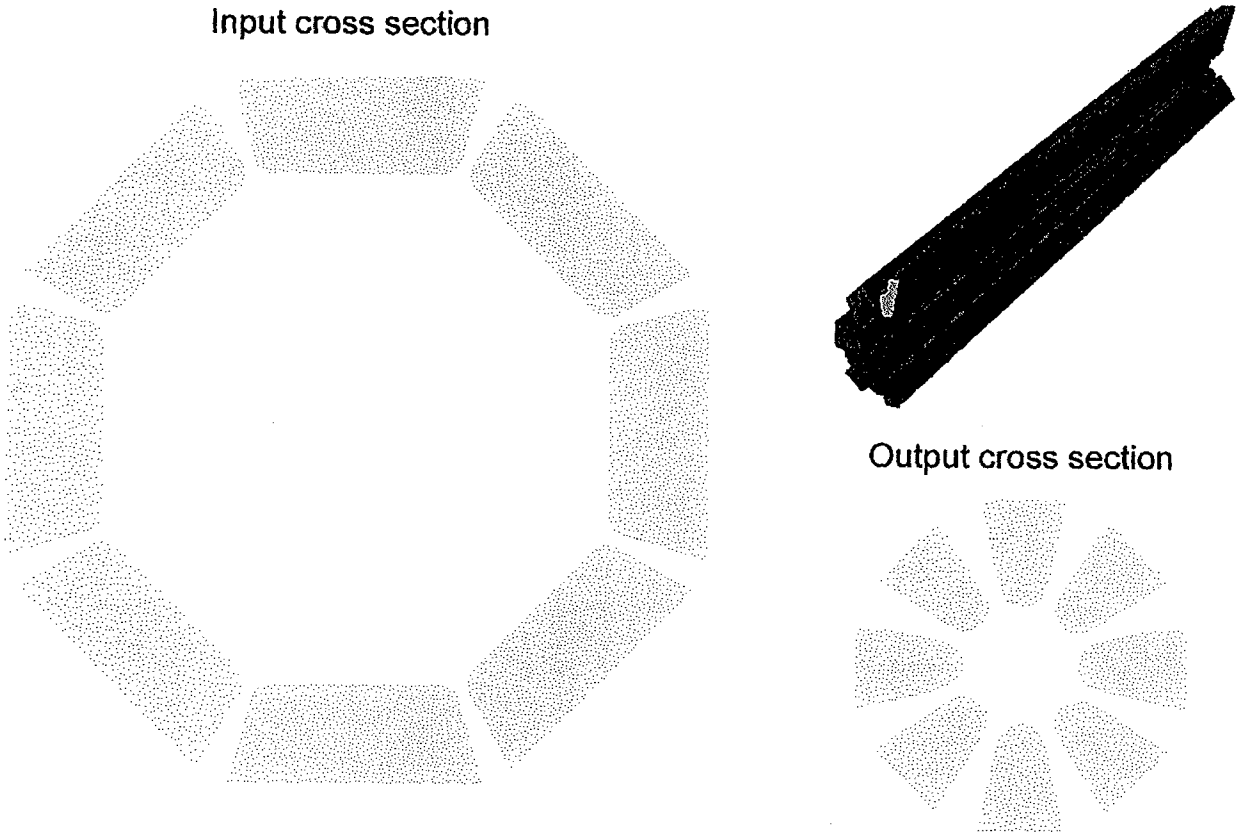
FIG. 5 shows cross-sectional views of an ion guide according to various embodiments of the applicant's teachings.
Figure 6:
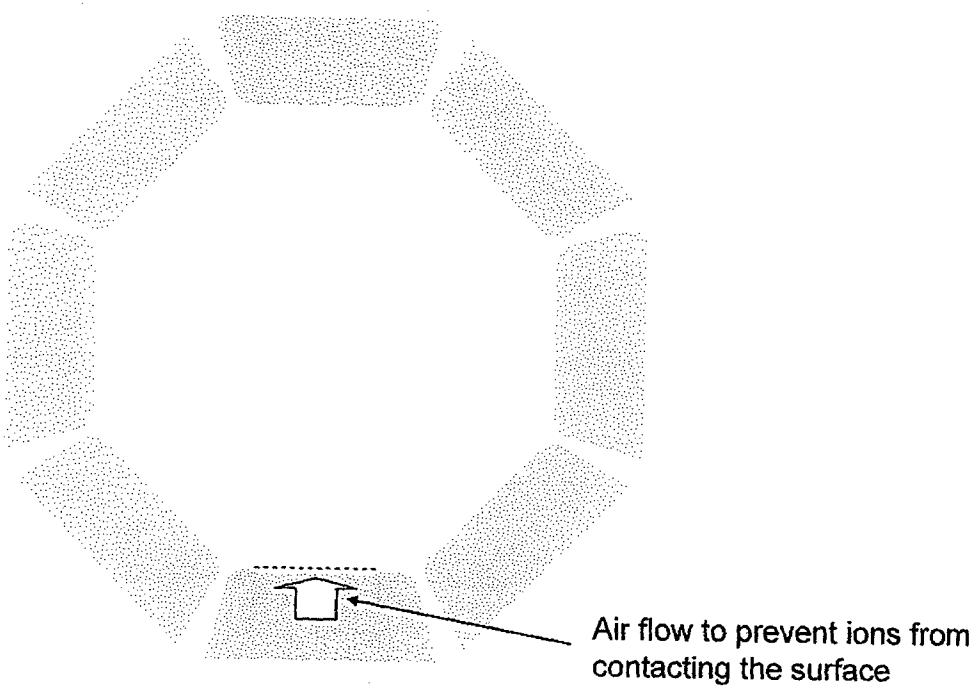
FIG. 6 shows a cross-sectional view of an ion guide according to various embodiments of the applicant's teachings.

FIGS. 5 and 6 exemplify input and output cross-sections as well as an axial cross section of a tapered octapole ion guide. For simplification, FIG. 6 shows a cross-section of a tapered octapole ion guide with one electrode featuring gas flow to prevent ions from contacting the surface in the planar region. In various embodiments, all electrodes can comprise a repelling gas flow arrangement to prevent ions from contacting the surface in the planar region. In the ion guides, ion loss can be further reduced by providing a flow of buffer gas that would prevent ions from contacting the surface of the electrodes in the planar section where the effect of RF pseudo-potential is weak as illustrated in FIG. 6. A mesh is covering the planar section of the electrode and allows additional buffer gas to pass through therefore dragging the ions away from the surface where they could be neutralized and lost upon contact.

Figure 7:
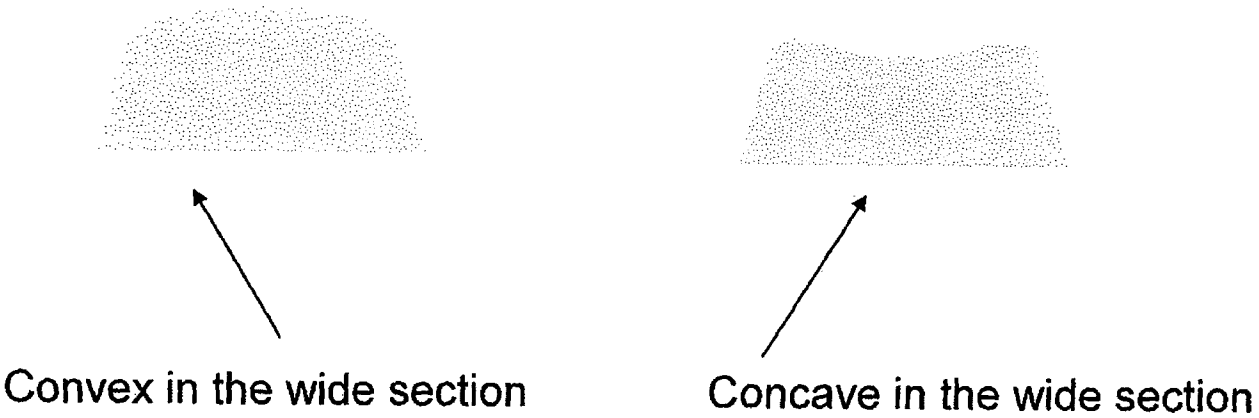
FIG. 7 shows cross-sectional views of an ion guide according to various embodiments of the applicant's teachings.

Reference is made to FIG. 7 which shows alternative cross-section shapes of the electrodes of an ion guide according to various embodiments of the applicant's teachings. In various aspects, the planar portion of the electrodes can be shaped as convex or concave surface as illustrated in FIG. 7. The ion confinement at the seams is not significantly affected by the change of the shape in the planar section while alteration of the shape may have a benefit of better matching with incoming ion beam or provide a small additional RF pseudo-potential field that would push ions towards the axis. In various embodiments, the conical shape of the ion guide can be altered from a straight linear cone into a parabolic cone or any other suitable curve rotated around the axis. Deviation from a straight cone can make the gas flow through the seams more uniform along the length of the ion guide or make the gas flow through the seams diminish slightly towards the exit of the ion guide. These arrangements can ensure that if ions are confined by the seam near the entrance, they will continue to be confined as they move along towards the exit of the ion guide.

Figure 8A:
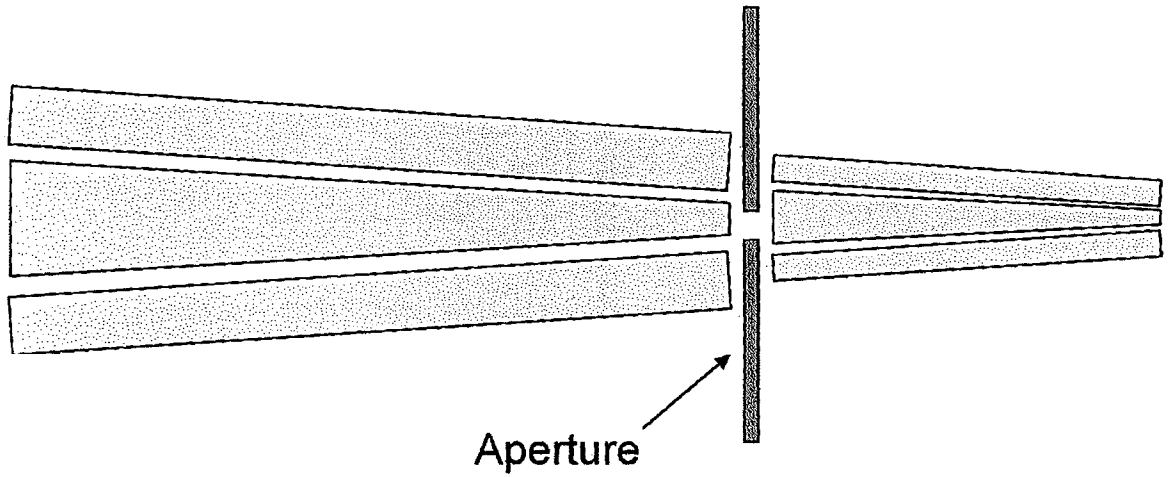
FIG. 8A is a schematic view of an ion guide according to various embodiments of the applicant's teachings.

Reference is made to FIG. 8A which shows that more than one ion guide can be stacked one after another according to various embodiments of the applicant's teachings. In various embodiments, a series of ion guides can be provided. FIG. 8A shows an arrangement where the output ion beam of the first ion guide is connected to the input of the following ion guide. In various embodiments, an aperture optionally can be placed between the two ion guides to separate electrical fields and control the gas flow between two sections.

In various aspects, utilizing stacked ion guides can comprise a higher order multipole ion guide at the entrance followed by a quadrupole ion guide. If the setup is located in one section of the vacuum interface the gaps w and shape r of the first and the second ion guide can be made the same and the same RF voltage can be applied in both sections. In such a setup, the pseudo-potential confinement as well as gas flows at the seams of the first and second stages will be similar ensuring effective confinement of ions in both sections. For example, a setup with a dodecapole in the first section can connect to a quadrupole. The dodecapole ion guide that starts with the same width of the planar electrode W will have roughly 3 times larger inlet diameter than the following quadrupole resulting in about an order of magnitude larger inlet area. Moreover, the ion beam at the output of the quadrupole ion guide can be better focused than the ion bean at the output of the octapole ion guide thus simplifying passing of the ion beam into the next section of a mass spectrometer through an aperture (not shown). In various embodiments of the stacked ion guides, it can be beneficial to split the setup into two sections of differential pumping as shown in FIG. 8B.

Figure 8B:
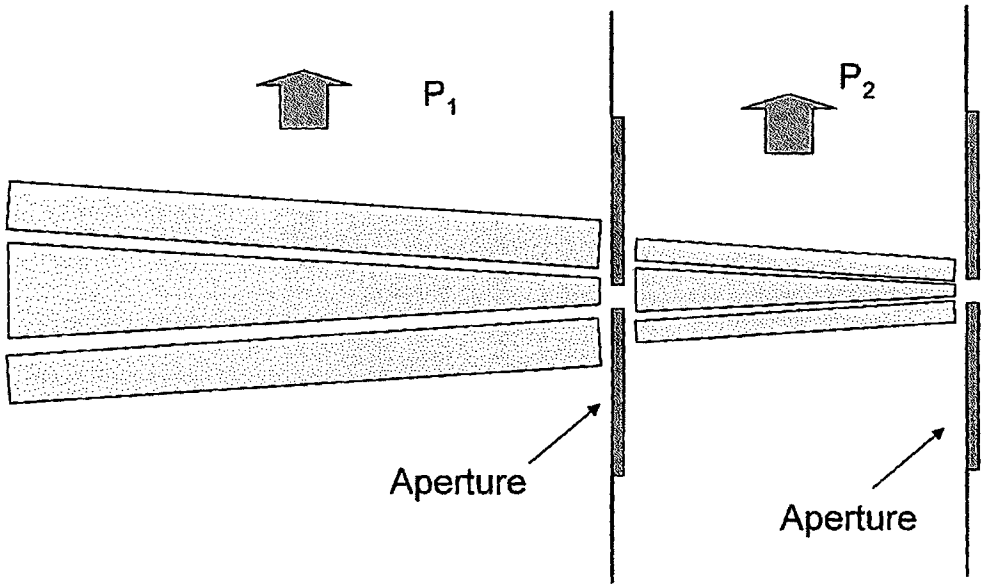
FIG. 8B is a schematic view of an ion guide according to various embodiments of the applicant's teachings.

In FIG. 8B, for example, the pressure in the first section P1 is higher than the pressure in the second section P2. The first and the second sections are interconnected with an aperture for passing the ion beam. Large portions of the buffer gas in the first section are pumped away using pumping means connected to the first section. Residual gas flow from the first section enters the second section via the aperture together with the ion flux. The pressure in the second section is maintained below the pressure in the first section using pumping means connected to the second section. The output ion beam from the second section can be passed to the next stage of a mass spectrometry system. In this embodiment, since the pressures in the first and second sections are not identical there is no advantage to keeping both ion guides with the same w, r dimensions and RF voltages and frequencies. Each ion guide can have the optimal dimensions and RF parameters determined by the operating pressures and the flows of buffer gas in each section.

Figure 8C:
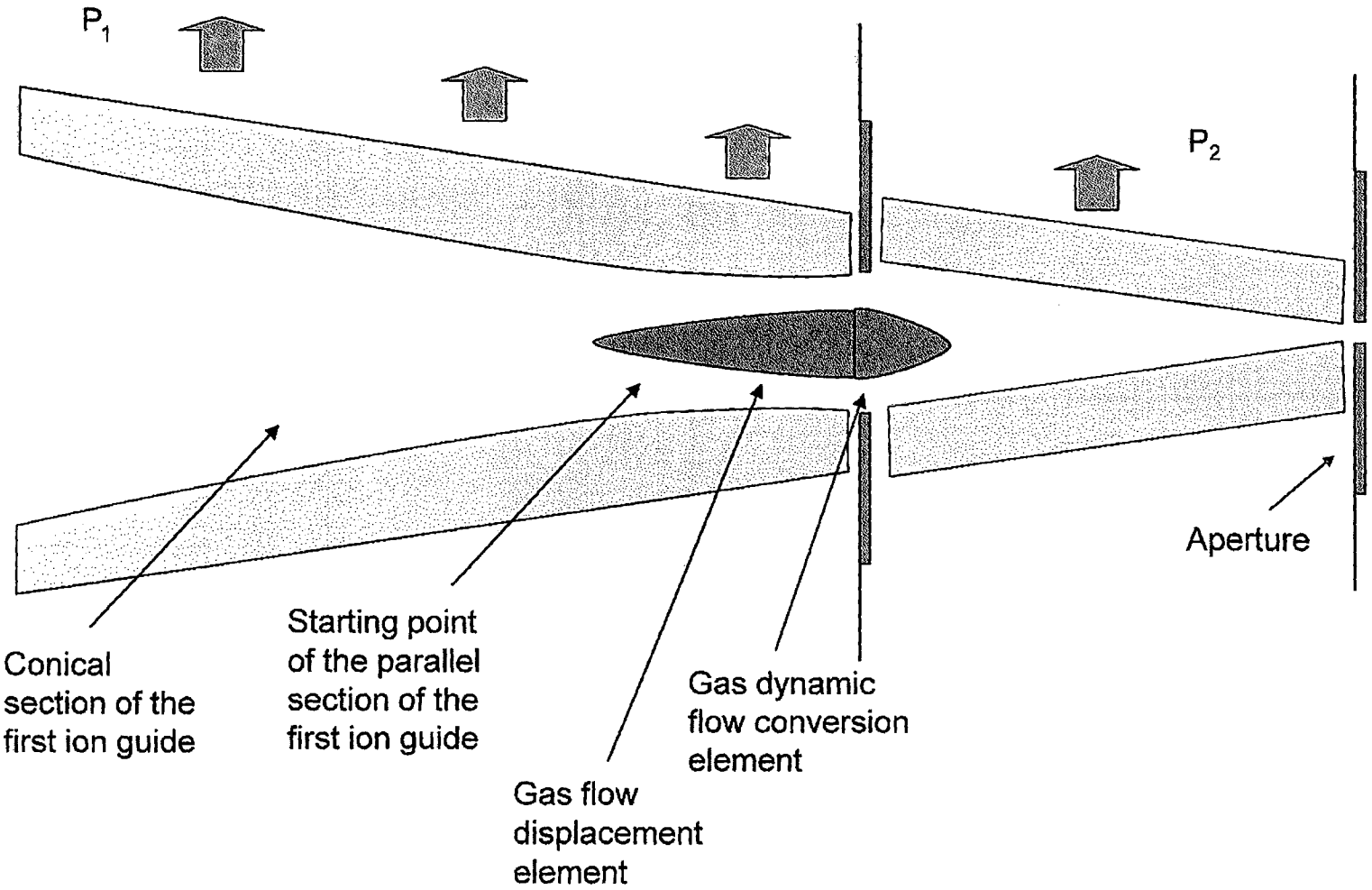
FIG. 8C shows a cross-sectional view of a two stage ion guide setup according to various embodiments of the applicant's teachings.

Reference is made to FIG. 8C which exemplifies a cross section of a two stage ion guide setup in which the diameter of the entrance end of the second ion guide is smaller than the diameter of the exit end of the first ion guide. The flow in the first stage can be initially displaced by reduction in cross-sectional area due to the conical shape of the inside of the ion guide. Towards the exit of the first ion guide, for example, a parallel (cylindrical) section is shown where the gas flow additionally can be displaced by inserting a gas flow displacement element, which, for example, is shown in the middle of the setup located towards the exit end of the ion guide. In various embodiments, the gas flow displacement element can reduce the cross-sectional area of an ion guide towards the exit. In various aspects, the gas flow displacement element can be of various shapes. At the exit of the first stage, the ion beam entrained in the gas flow passes through an aperture and then enters the second stage of the ion guide. The flow of the gas is shaped by the gas dynamic flow conversion element.

Figure 8D:
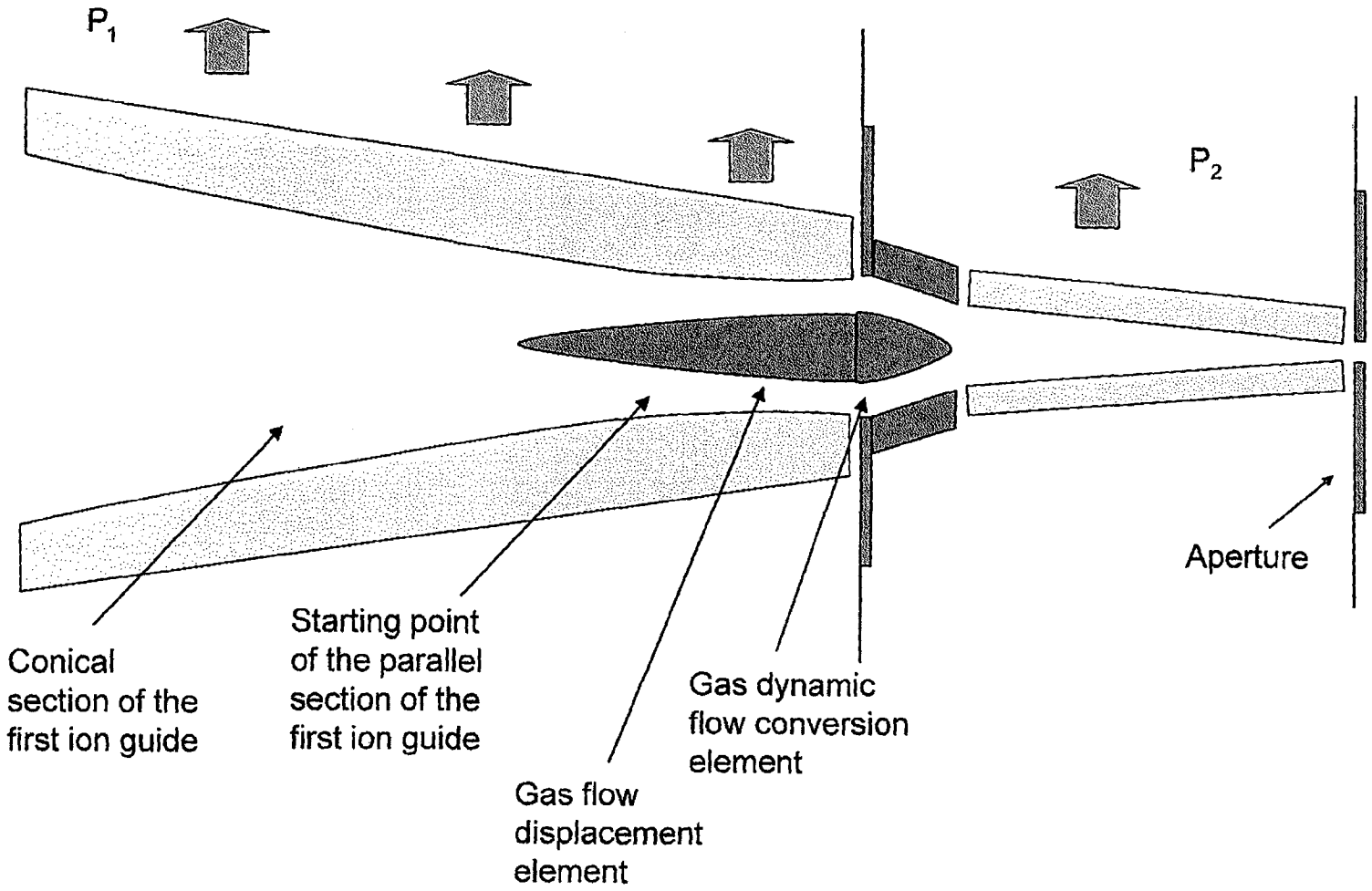
FIG. 8D shows a cross-sectional view of a two stage ion guide setup according to various embodiments of the applicant's teachings.

In FIG. 8D, at the exit of the first stage, the ion beam entrained in the gas flow passes through an aperture and then enters the gas dynamic flow conversion element. In various aspects, the gas dynamic flow conversion element can be of various shapes. At the output of the gas flow conversion element, the flow is axial, round and nearly uniform. This flow of gas and ions enters the second stage of the ion guide which continues to displace the gas flow while bringing the ion beam closer to the axis. A concentrated ion beam leaves the second stage through the output aperture.

Figure 8E:
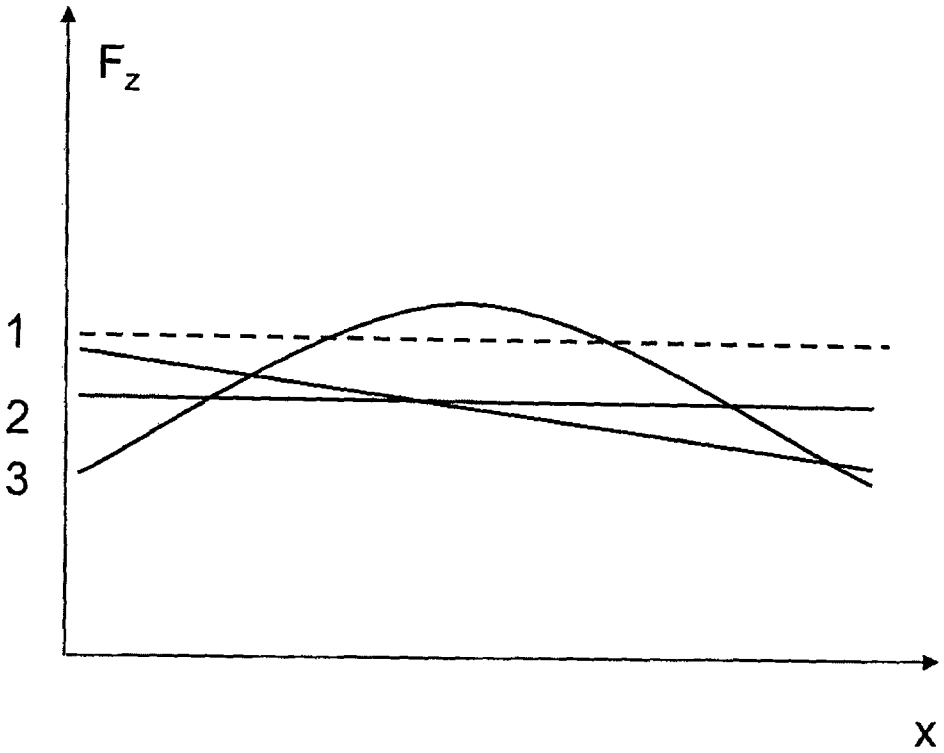
FIG. 8E shows the distance along the axis of the ion guide versus the magnitude of the gas drag force exerted on ions of a given type in the seam of the ion guide.

FIG. 8E shows x, the distance along the axis of the ion guide, versus Fz, the magnitude of the gas drag force exerted on ions of a given type in the seam of the ion guide. Solid curves 1, 2, and 3 show different scenarios for the gas drag profile created by the variation of cross section of the ion guide along the axis. The dashed line shows the limit of RF confinement. If the gas drag profile has a shape number 3 for a given type of ions, a majority of these ions will be swept away by the gas flow and lost as the ions move along from the entrance to the exit. The loss will occur as the ions enter the area where the gas drag force is higher than the RF force.

Figure 9:
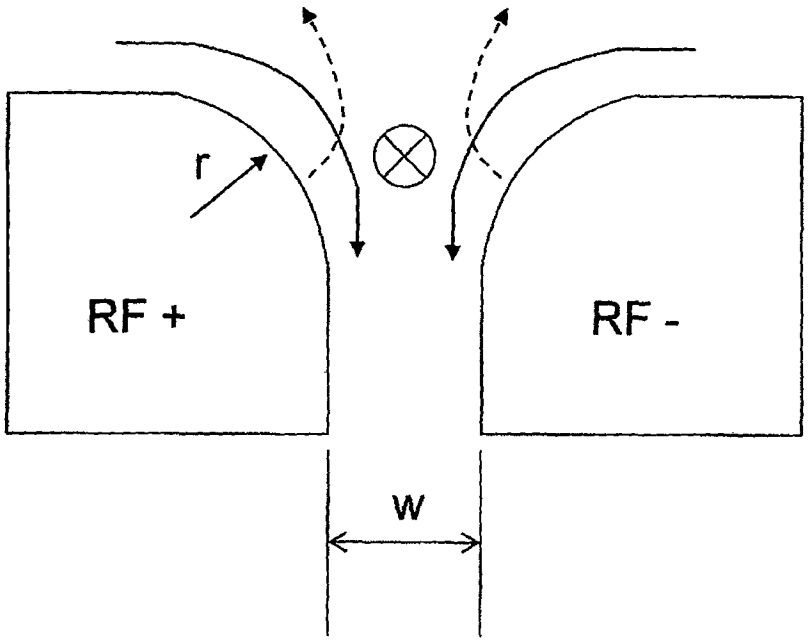
FIG. 9 shows a cross-sectional view of an ion-gas separation element according to various embodiments of the applicant's teachings.

Reference is made to FIG. 9 which shows a cross-sectional view of an ion-gas separation element. Solid arrow lines designate the gas flow component going through the gap between RF+ and RF− electrodes. The circle with a cross designates a gas flow velocity component in the direction perpendicular to the surface as indicated in the drawing. Dashed lines designate directions of the repelling forces created by the pseudo-potential from oscillating RF voltages applied to RF+ and RF− electrodes. The net effect of the gas drag and the pseudo-potential force pushes the ions towards the middle of the gap where the ions can reside in equilibrium while traveling along the axis in the direction designated by the circle with the cross.

Figure 10:
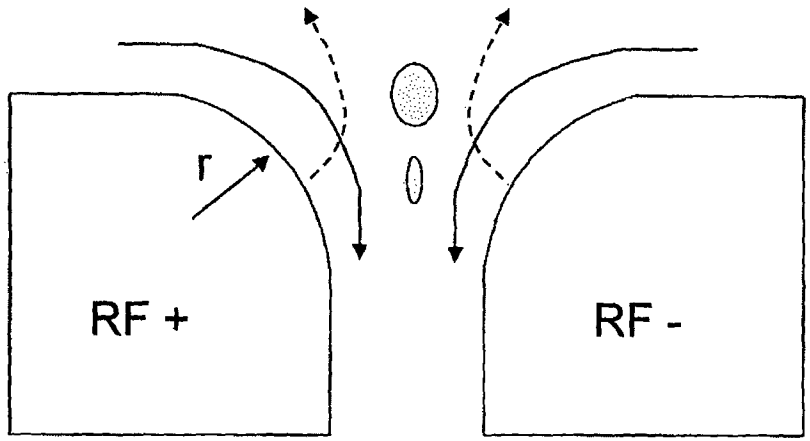
FIG. 10 shows a cross-sectional view of an ion-gas separation element according to various embodiments of the applicant's teachings.

Reference is made to FIG. 10 which shows elliptical regions representing the location of the ion beams in equilibrium. Clouds of different ions can be centered at a different position defined by the counteraction of the gas drag force (solid arrows) and the pseudo-potential force (dashed arrows).

Figure 11:
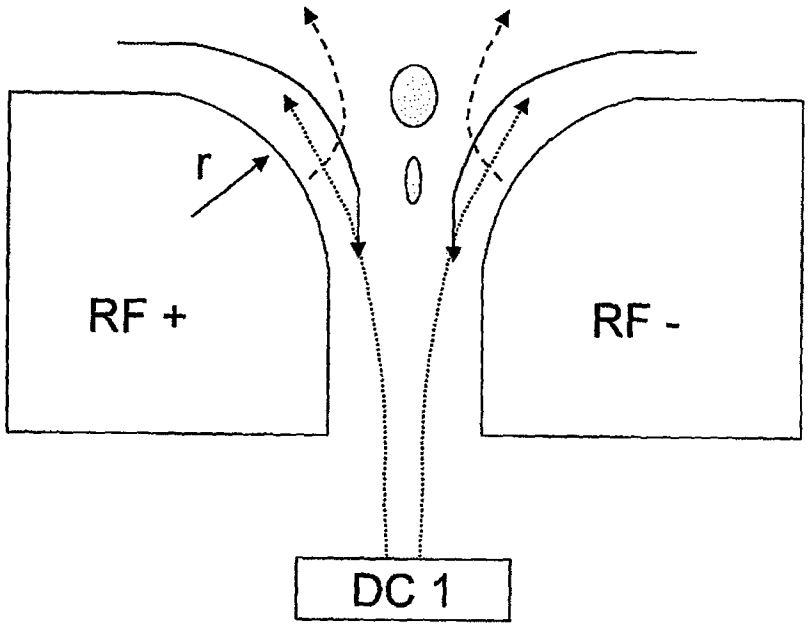
FIG. 11 shows a cross-sectional view of an ion-gas separation element according to various embodiments of the applicant's teachings.

Reference is made to FIG. 11 which shows an extra electrode with an auxiliary DC1 voltage added to aid in ion confinement. Dotted arrows show an additional force superimposed on ions due to the application of the DC1 potential. This DC field can help counteract the gas drag force due to the gas flow.

Figure 12:
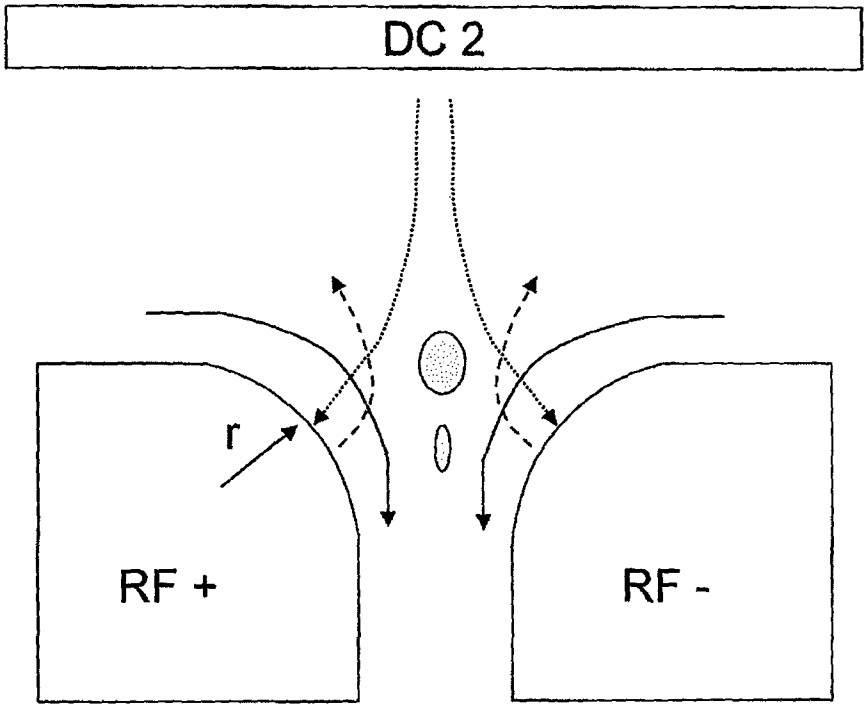
FIG. 12 shows a cross-sectional view of an ion-gas separation element according to various embodiments of the applicant's teachings.

Reference is made to FIG. 12 which shows an extra electrode with an auxiliary DC2 voltage added to ensure that ions are confined in the channel. This arrangement can be helpful when the gas drag force is not too strong, for example in the exit region of the ion guide. Dotted arrows show an additional force superimposed on ions due to the application of DC2 potential. This arrangement can be useful after ions were already collected in the gap by the gas drag force at the initial stage and are carried along the gap while the strength of the gas drag force is declining.

Efficient sampling of ions requires that the entrance diameter of the ion guide be sufficiently large to capture ions entrained in the incoming gas flow. For an ion guide to operate efficiently at higher pressure, its RF frequency has to be kept higher than the rate of dampening of ion motion due to collisions. However, a larger ion guide diameter entrance can lead to lower operating RF frequency making RF confinement of ions weak and inefficient at higher pressure. Furthermore, the gas drag on the ions can have a more pronounced effect at the entrance portion of the ion guide since the gap between the rods will be larger at this portion. The combination of a weak RF confinement of the ions and the stronger gas drag at the entrance portion of the ion guide can lead to ion losses. Therefore, it is desirable to provide an ion guide that can provide sufficient ion confinement while operating at a higher RF frequency.

However, during transportation of the ions through the ion guide, ion losses can occur. Therefore, it is desirable to increase transport efficiency of the ions along the ion guide and prevent the loss of ions during transportation to attain high sensitivity.

In mass spectrometry, sample molecules are converted into ions using an ion source, in an ionization step, and then detected by a mass analyzer, in mass separation and detection steps. For most atmospheric pressure ion sources, ions pass through an inlet aperture prior to entering an ion guide in a vacuum chamber. The ion guide transports and focuses ions from the ion source into a subsequent vacuum chamber, and a radio frequency signal can be applied to the ion guide to provide radial focusing of ions within the ion guide. However, during transportation of the ions through the ion guide, ion losses can occur.

Figure 13A:
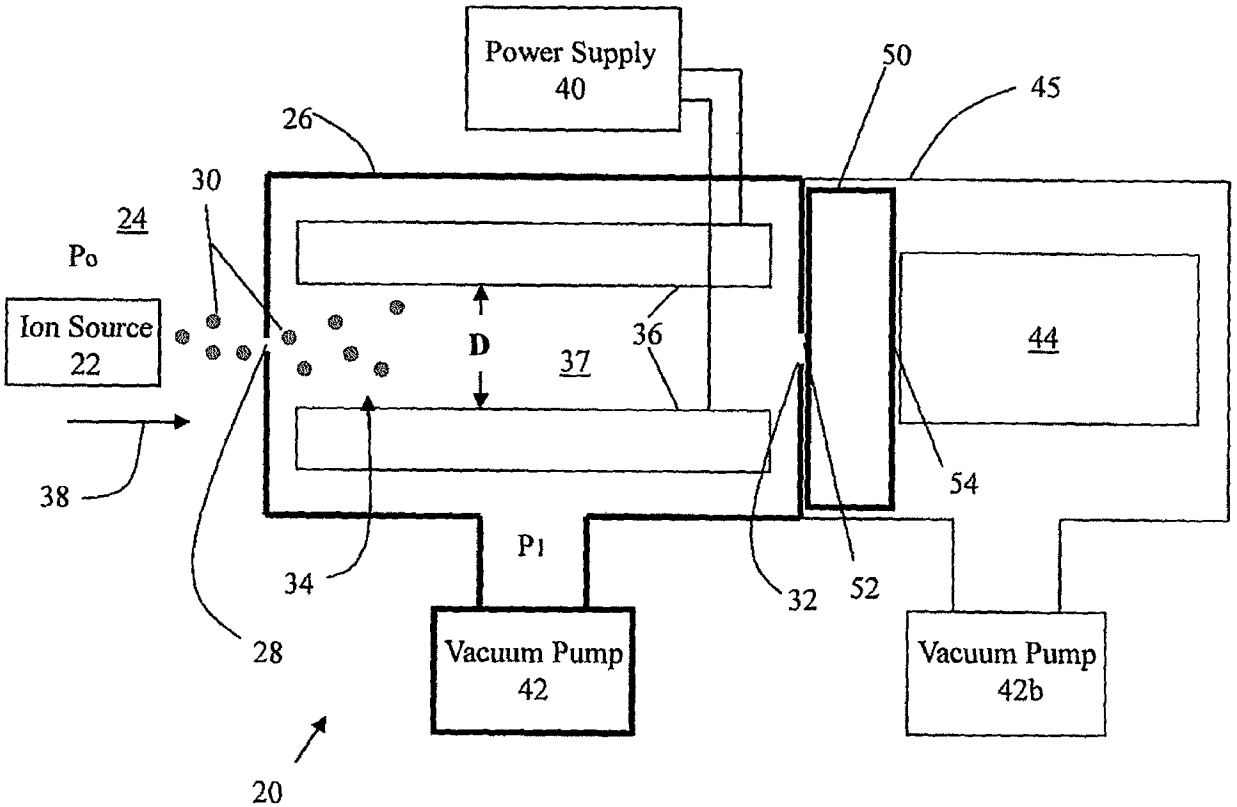
FIG. 13A is a schematic view of a mass spectrometry system according to various embodiments of the applicant's teachings.

Accordingly, an apparatus and method is provided for transmitting ions. Reference is made to FIG. 13A, which, shows schematically a mass spectrometer, generally indicated by reference number 20. In FIG. 13A, unless otherwise indicated, common elements have the same reference numerals as in FIG. 1 and for brevity the description of these common elements, already described above, has not been repeated. In various aspects, the mass spectrometer 20 comprises an ion source 22 for generating a beam of ions 30 from a sample of interest, not shown, in a high pressure region $P_0$. In various embodiments, the ion source 22 can be positioned in the high-pressure P0 region containing a background gas (not shown), generally indicated at 24, while the ions 30 travel towards a first vacuum chamber 26, in the direction indicated by the arrow 38. In various aspects, the ions enter the first vacuum chamber 26 through an inlet aperture 28 which passes the ions from the high-pressure region into the first vacuum chamber 26. In various embodiments, one or more inlet apertures can be provided. In various aspects, an array of smaller inlet apertures can be provided. In various aspects, the array of smaller inlet apertures can be circular or elongated. In various embodiments, the total area of the array of smaller apertures can be comparable to the total area of a single inlet aperture that has a diameter between about 0.1 mm and about 5 mm. In various aspects, the array of smaller inlet apertures can be arranged in any suitable pattern depending on the requirements of the ion source. For example, the array of smaller orifices can be arranged in, but is not limited to, a circular, square, hexagonal, or linear pattern. The first vacuum chamber 26 also comprises an exit aperture 32 for passing the ions 30 from the first vacuum chamber 26.

Efficient transfer of ions between two compartments of a vacuum system where the pressure of the buffer gas on one side is sufficiently high, for example above 1 torr, and where the emitting cross section of the upstream RF ion guide does not match accepting cross sections of the ion optical element in the following section can be problematic. The applicant has realized that this problem can be overcome by relying on the flow of the buffer gas that is shaped by the gas conduit. When ions are transferred between two stages of a mass spectrometer and at least one stage is located at sufficiently high pressure, the ions can be carried by the gas flow and the loss of ions due to diffusion to the walls can be sufficiently small. An additional "curtain" gas can be introduced near the walls of the gas dynamic interface to create an extra cushion for ions and further reduce diffusion losses. To solve the problem with the ion beam being spread as a ring (annular ion beam) or as a line (linear ion beam), we can take advantage of gas dynamics that is quite strong when operating at higher pressure and provide a gas dynamic ion transfer device 50.

In various embodiments, a gas dynamic ion transfer device 50 can be provided at the exit aperture 32 of the first vacuum chamber, the gas dynamic ion transfer device 50 having an inlet end 52 and an outlet end 54 wherein the ions pass through the inlet end 52 and exit through the outlet end 54 of the gas dynamic ion transfer device 50. In various aspects, the gas dynamic ion transfer device can be configured to converge the ions entrained in a flow of gas. In various embodiments, the gas dynamic ion transfer device can comprise a funnel geometry. In various aspects, the gas dynamic ion transfer device can comprise an insert. In various aspects, the gas dynamic ion transfer device can comprise channels at the inlet end for converging the beam of ions. In various embodiments, the gas dynamic ion transfer device can be configured to spread the beam of ions. In various aspects, the gas dynamic ion transfer device can be between the first vacuum chamber and a second vacuum chamber.

In various aspects, a power supply 40 can provide an RF voltage to the at least one ion guide 36 for radially confining the ions within the internal volume 37 of the at least one ion guide. In various embodiments, multiple phases of RF can be provided.

Figure 13B:
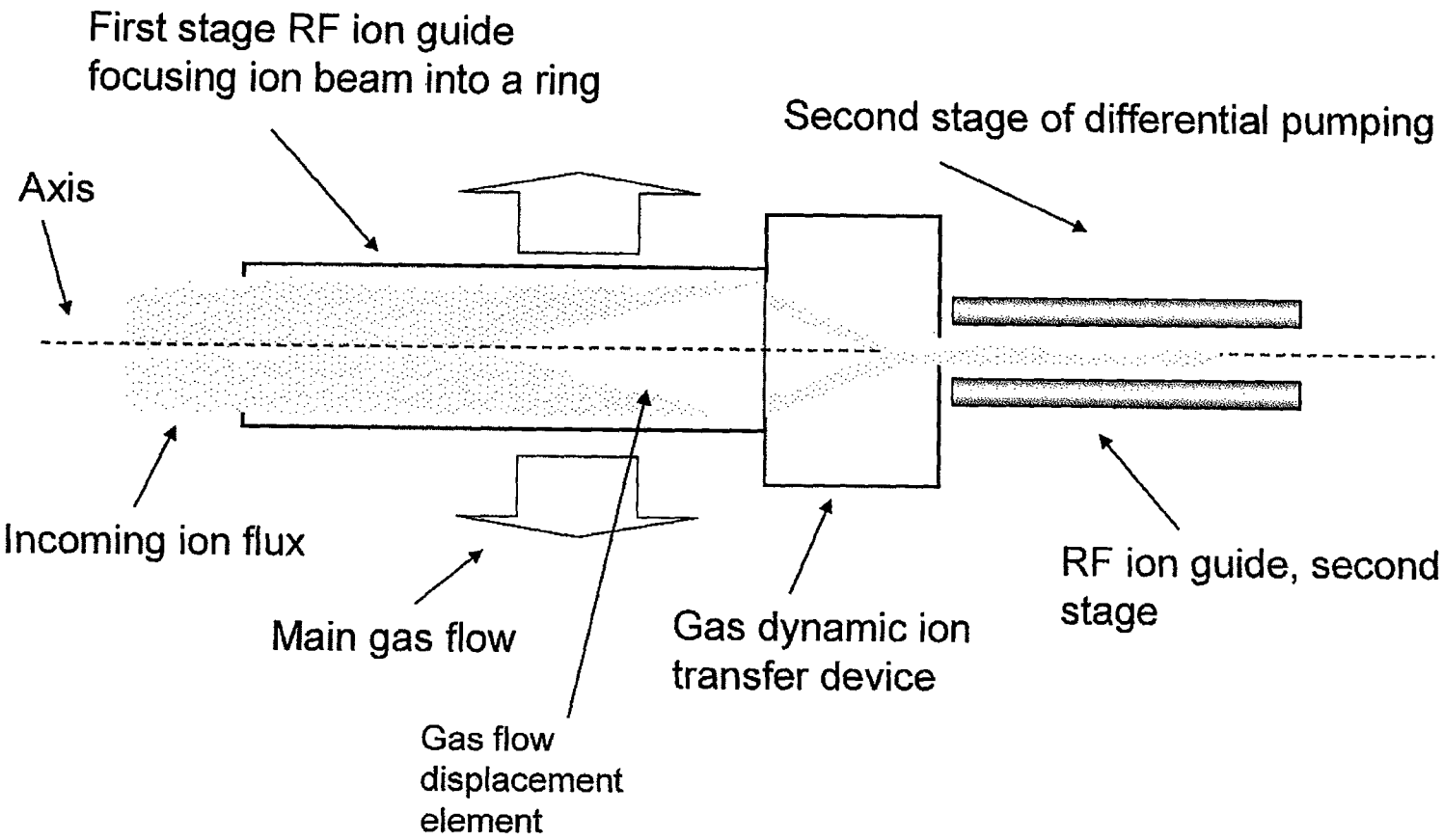
FIG. 13B shows a top view of a gas dynamic ion transfer device according to various embodiments of the applicant's teachings.

Reference is made to FIG. 13B which shows a gas dynamic ion transfer device that can be inserted to connect the first and second stages of differential pumping. In various embodiments, the gas dynamic ion transfer device can be of various shapes. The figure also shows a gas flow displacement element which can gradually displace the gas and can lead to, for example, the creation of an annular (ring shaped) gas flow. The gas flow displacement element can be part of the gas dynamic interface, or it can be a standalone element. In various embodiments, the gas flow displacement element can be located towards the exit end of the ion guide. In various embodiments, the gas flow displacement element can reduce the cross-sectional area of an ion guide towards the exit. In various aspects, the gas flow displacement element can be of various shapes.

Figure 13C:
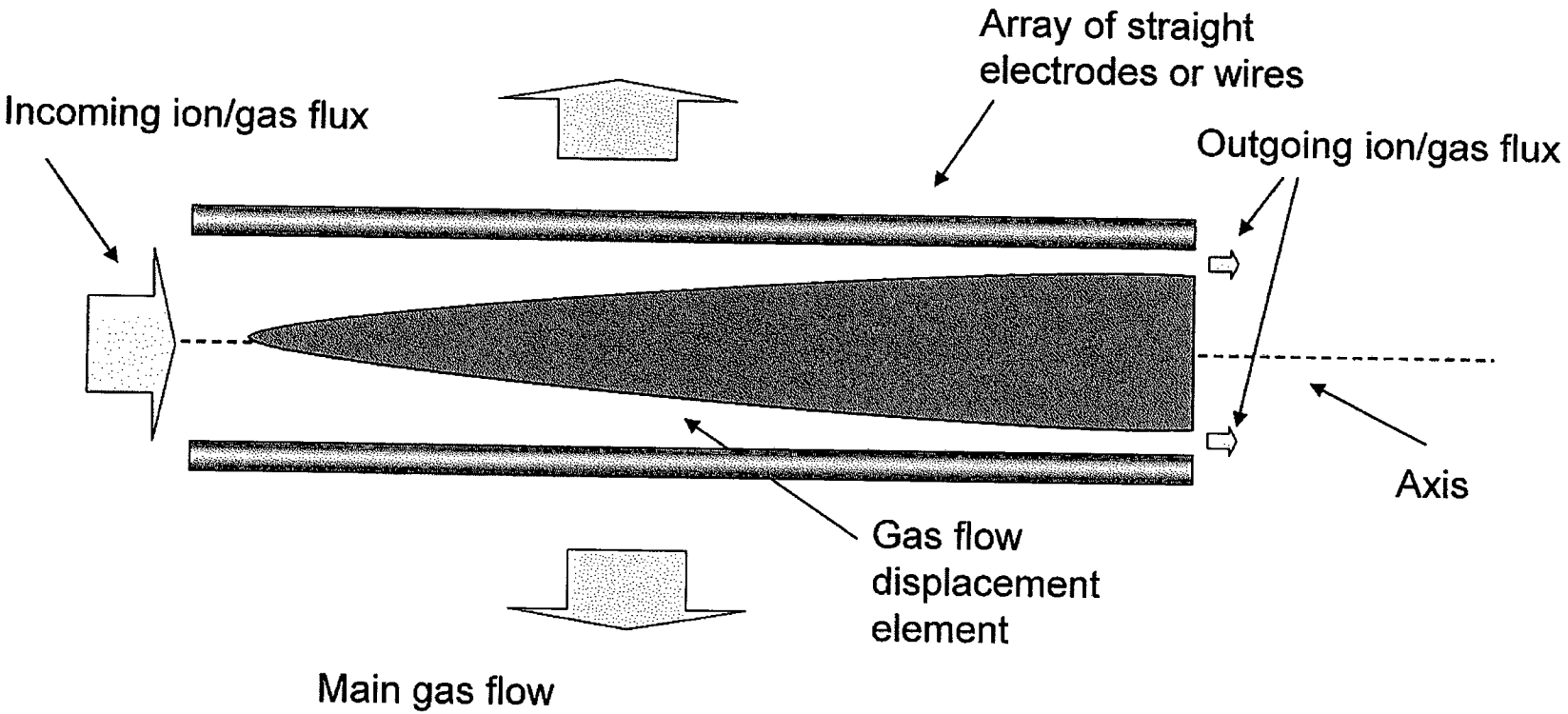
FIG. 13C shows a detailed view of the gas flow displacement element of FIG. 13B.

FIG. 13C shows in greater detail the gas flow displacement element of FIG. 13B as a part of gas dynamic interface. The cross section at the entrance of the ion guide is larger than the cross section at the exit since part of the exit area is blocked by the gas flow displacement element.

In various aspects, the gas flow displacement element can have the advantage of reducing the rate of contamination of the ion optics downstream of the gas flow displacement element since the element will effectively disperse and block small dust particles and droplets from entering the following stages of the mass spectrometer. In various embodiments, the gas flow displacement element has a channel or a set of channels to provide an additional flow of curtain gas that prevents ions from contacting the surface of the gas flow displacement element similar in function to the gas flow setup shown in FIG. 6 where additional gas flow is used to prevent ions from contacting flat portion of RF electrodes.

Figure 14:
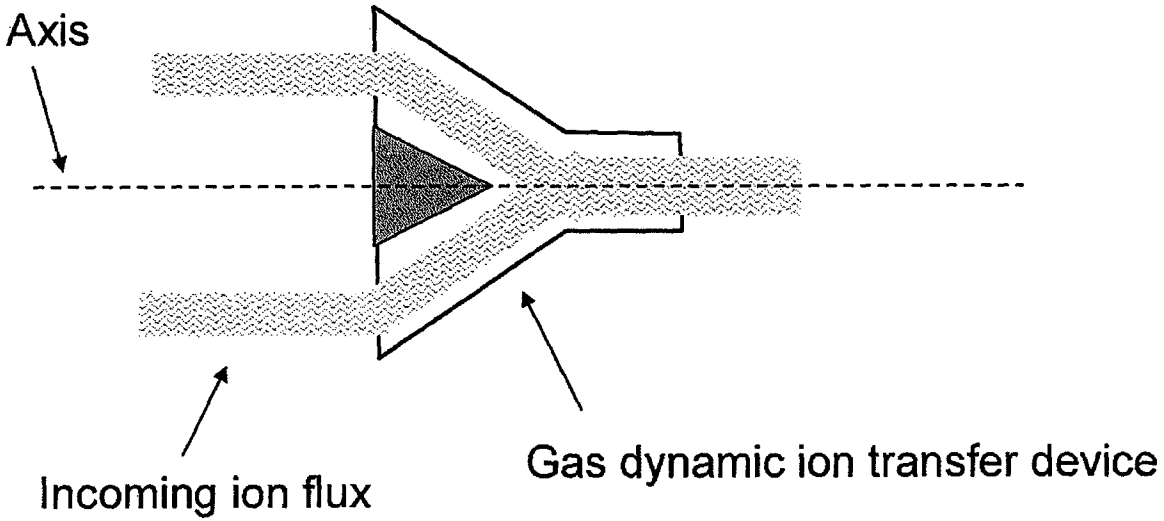
FIG. 14 is a schematic view of a gas dynamic ion transfer device according to various embodiments of the applicant's teachings.

Reference is made to FIG. 14 which shows a funnel style gas dynamic ion transfer device for collecting an annular ion beam provided at the output of RF ion guide and converting it into a flow from a round tube.

Figure 15:
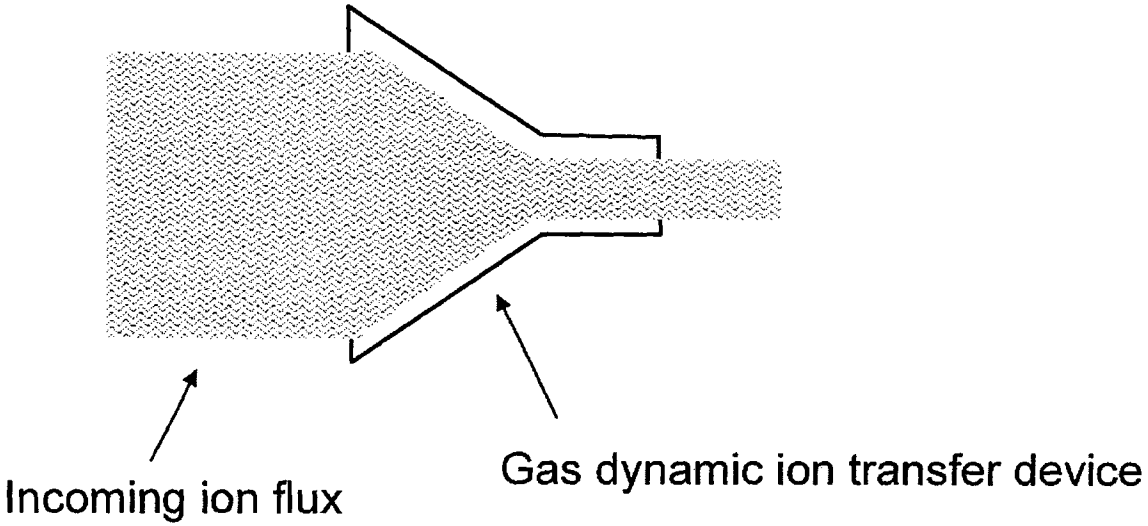
FIG. 15 is a schematic view of a gas dynamic ion transfer device according to various embodiments of the applicant's teachings.

Reference is made to FIG. 15 which shows a planar gas dynamic ion transfer device for collecting a flat ion beam provided at the output of RF ion guide and converting it into a flow from a round tube.

Figure 16:
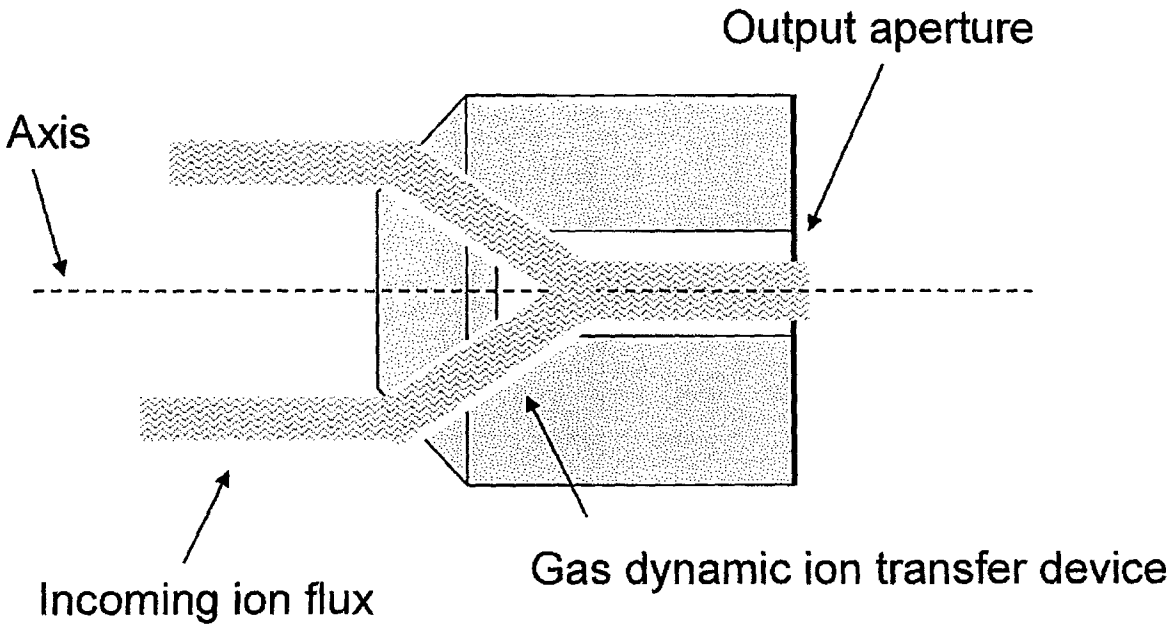
FIG. 16 a schematic view of a gas dynamic ion transfer device according to various embodiments of the applicant's teachings.

Reference is made to FIG. 16 which shows a gas dynamic ion transfer device utilizing channels at the inlet for collecting an annular ion beam provided at the output of RF ion guide and converting it into a flow from a round tube.

Figure 17:
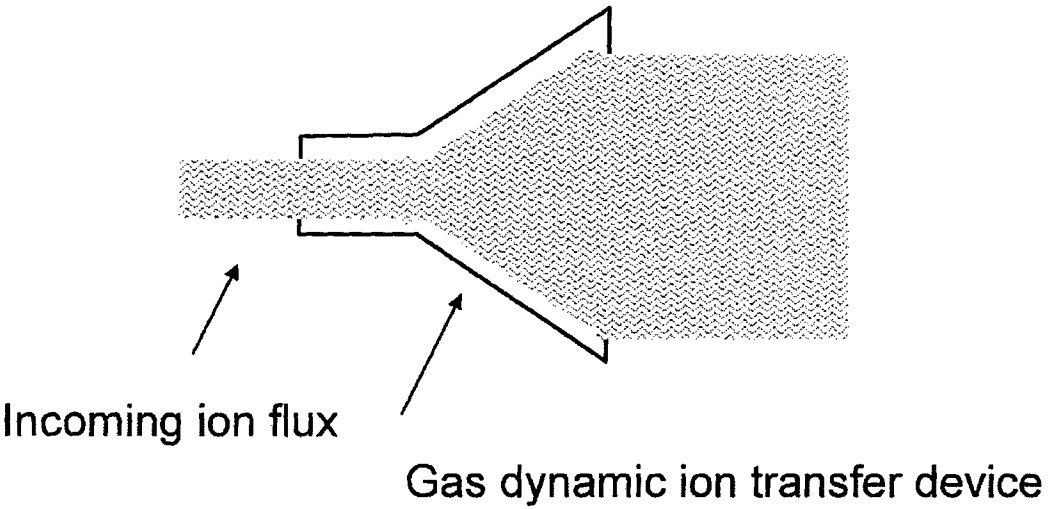
FIG. 17 a schematic view of a gas dynamic ion transfer device according to various embodiments of the applicant's teachings.

Reference is made to FIG. 17 which shows an inverted gas dynamic ion transfer device that samples a narrow beam provided at the output of RF ion guide and spreads it into a line at the output.

A planar RF ion guide can be defined as an ion guide that has its RF electrodes in one plane. This type of RF ion guide can be particularly well suited for manufacturing, for instance using a printed circuit board (PCB) as a supporting material. A planar RF ion guide with DC bias voltages can be applied for the purposes of guiding and compressing ion beams especially under higher pressure of buffer gas. The planar ion guide can comprise an array of RF elements. In various aspects, half of the elements can be connected to one phase of RF while the other half can be connected to the opposite phase of RF. In various embodiments, the planar RF ion guide can be operated with more than two phases of RF. In various aspects, multiple phases of RF can be provided. Multiple configurations of planar ion guides can be employed using basic elements. In various embodiments, the interface can utilize a single planar RF ion guide. In various aspects, gas flows and DC electrical fields can be organized to drive ions towards the surface of the planar RF ion guide and then move the ions in the vicinity of the surface across the ion guide towards the exit. In various embodiments, a travelling wave DC field can be organized by periodic grouping of neighboring RF elements and by applying varying DC fields that would propel the ions along the surface of the ion guide. In various aspects, in the process of moving towards the exit, ions can also be concentrated along the second dimension of the planar surface. In various aspects, the ions will be separated from the flow of the buffer gas and concentrated towards the exit to the next stage of the mass spectrometer.

In various aspects, a planar ion guide allows one to minimize the distance between neighboring opposite RF elements which in turn increases RF operating frequency of the ion guide. Higher RF frequency can enable operation of the ion guide at higher RF pressure. Multipole ion guides operating at higher frequency typically would have a limited number of closely spaced RF rods which leads to very small inscribed diameters precluding utilization of multipole ion guides for efficient capturing of wide ion beams. In many circumstances, it is desirable to accept wide incoming ion beam and pass it on to the next stage with smaller dimensions. RF ion guides with collisional cooling can do that, however their operation at very high pressures of the buffer gas is often hampered by the collisions between ions and buffer gas molecules. In order for an ion guide to operate at higher pressure, its RF frequency has to be kept higher than the rate of dampening of ion motion related to the frequency of collisions. For a given ion and a fixed RF voltage, the RF frequency of the ion guide can increase when its inscribed diameter is reduced. This allows for operation at higher pressure but reduces the diameter of the ion beam at the entrance (acceptance area). An ion funnel can accept a beam of wider dimensions and then compress it down to a smaller size, however an ion funnel is a complicated device that involves a stack of plates and many electrical connectors. Therefore, there is a need for ion beam compression at higher pressures of the buffer gas in several applications. The most notable application is sampling of ions produced at atmospheric pressure.

Figure 18A:
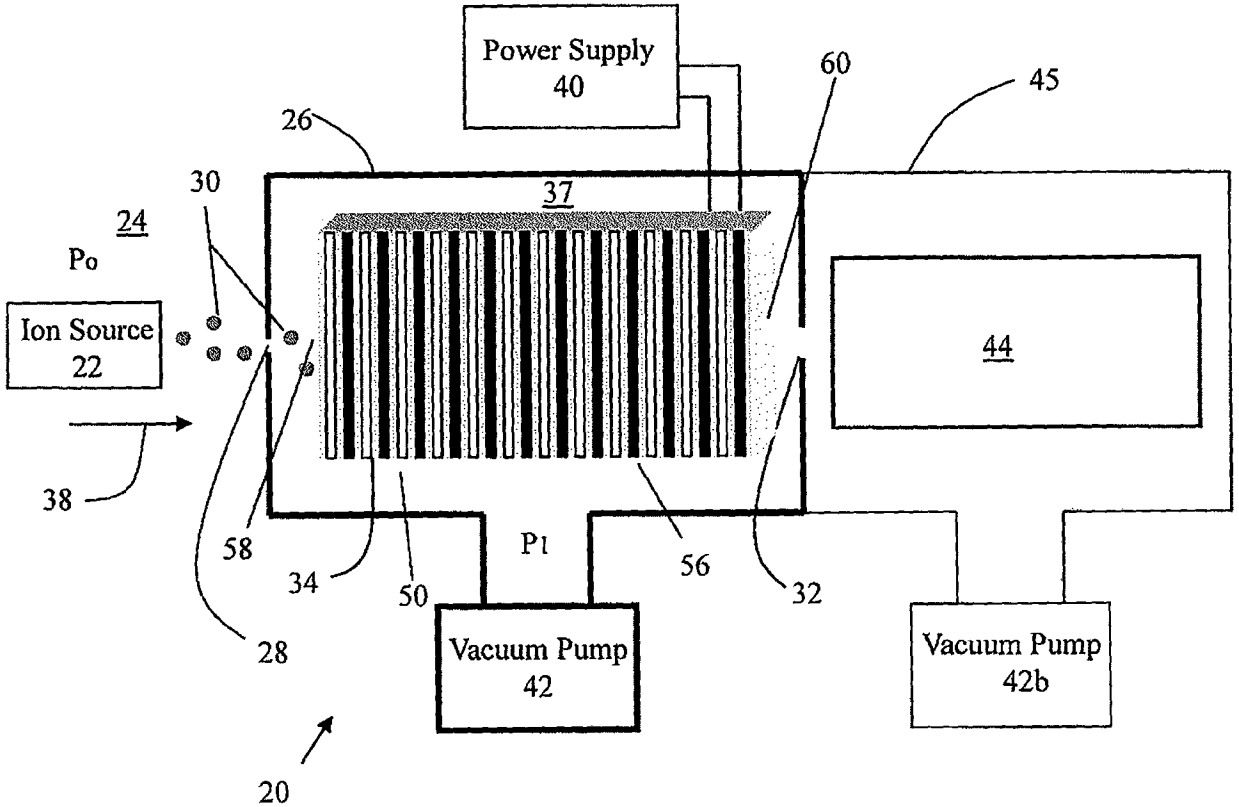
FIG. 18A is a schematic view of a mass spectrometry system according to various embodiments of the applicant's teachings.

The applicant realized that a planar ion guide can operate at higher RF frequency because its RF elements can be made closely spaced. Higher RF frequency will permit operation at higher pressure of the buffer gas. At the same time, the collection area of the ion guide can be kept large in order to efficiently capture ion beams originating from wide sources such as sampling from atmospheric pressure ion sources. In essence, the inventor realized that planar ion guides might be well suited for mass production, for instance, due to the technology developed for the manufacturing of printed circuit boards. Arranging planar ion guides in ways described here can lead to an efficient and economical ion collection interface. Accordingly, a mass spectrometer and method of transmitting ions is provided. Reference is made to FIG. 18A, which shows schematically a mass spectrometer, generally indicated by reference number 20. In various aspects, the mass spectrometer 20 comprises an ion source 22 for generating a beam of ions 30 from a sample in a high pressure region $P_0$, a vacuum chamber 26 comprising an inlet aperture 28 for passing the ions from the high-pressure region into the vacuum chamber 26, and an exit aperture 32 for passing the ions from the vacuum chamber 26. In FIG. 18A, unless otherwise indicated, common elements have the same reference numerals as in FIG. 1 and for brevity the description of these common elements, already described above, has not been repeated.

Figure 18B:
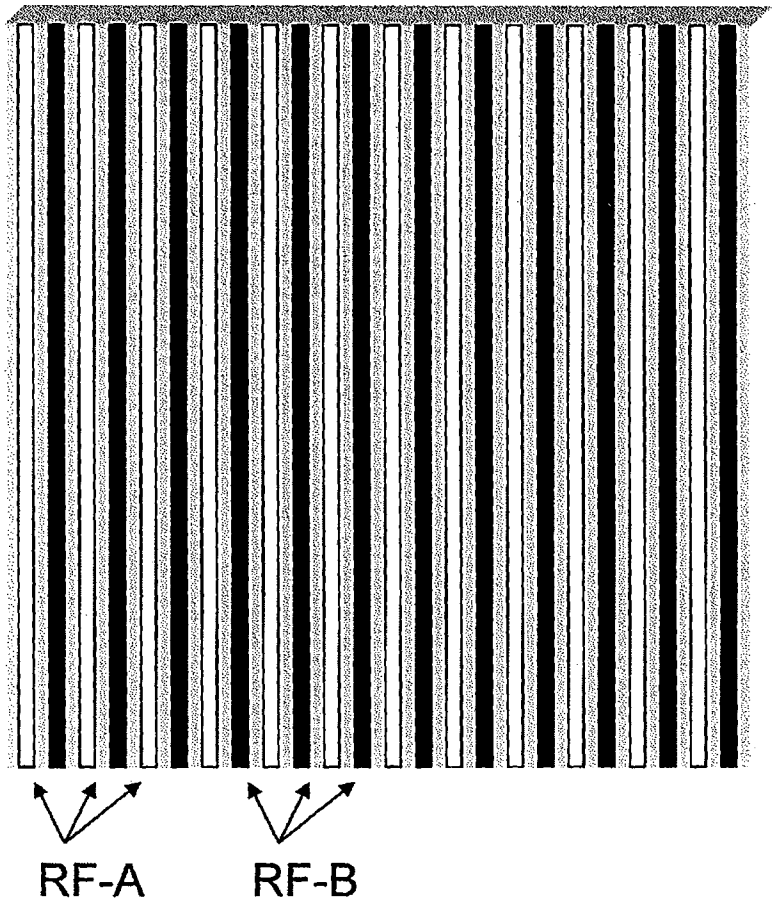
FIG. 18B is a schematic view of a planar ion guide according to various embodiments of the applicant's teachings.

In various embodiments, at least one planar RF ion guide 56 can be provided between the inlet 28 and exit 32 apertures, the at least one planar RF ion guide 56 having a first end 58 and a second end 60, the at least one planar RF ion guide 56 further having an array of RF elements, RF-A and RF-B, as shown in detail in FIG. 18B.

Figure 19:
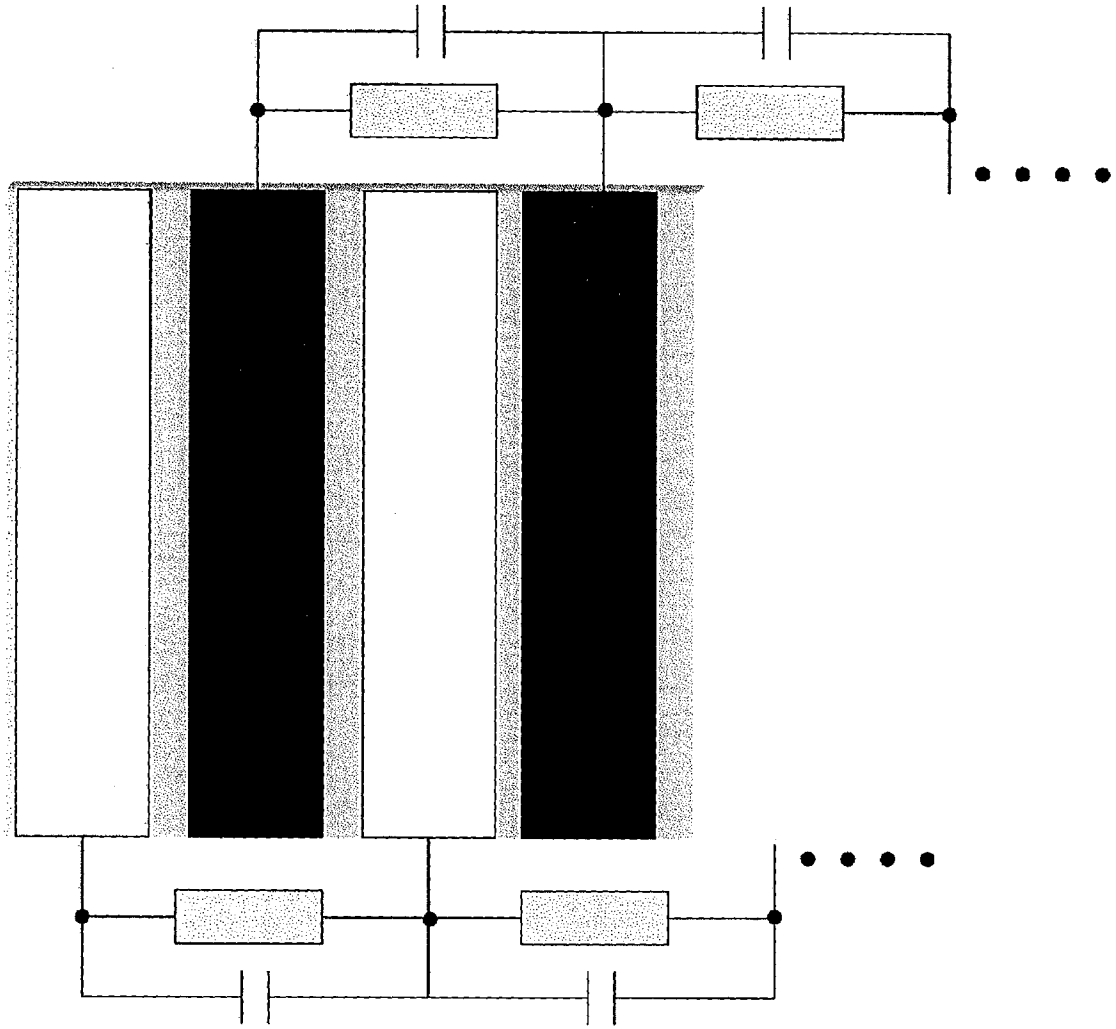
FIG. 19 is a schematic view of electrical connections to a planar ion guide according to various embodiments of the applicant's teachings.
Figure 20:
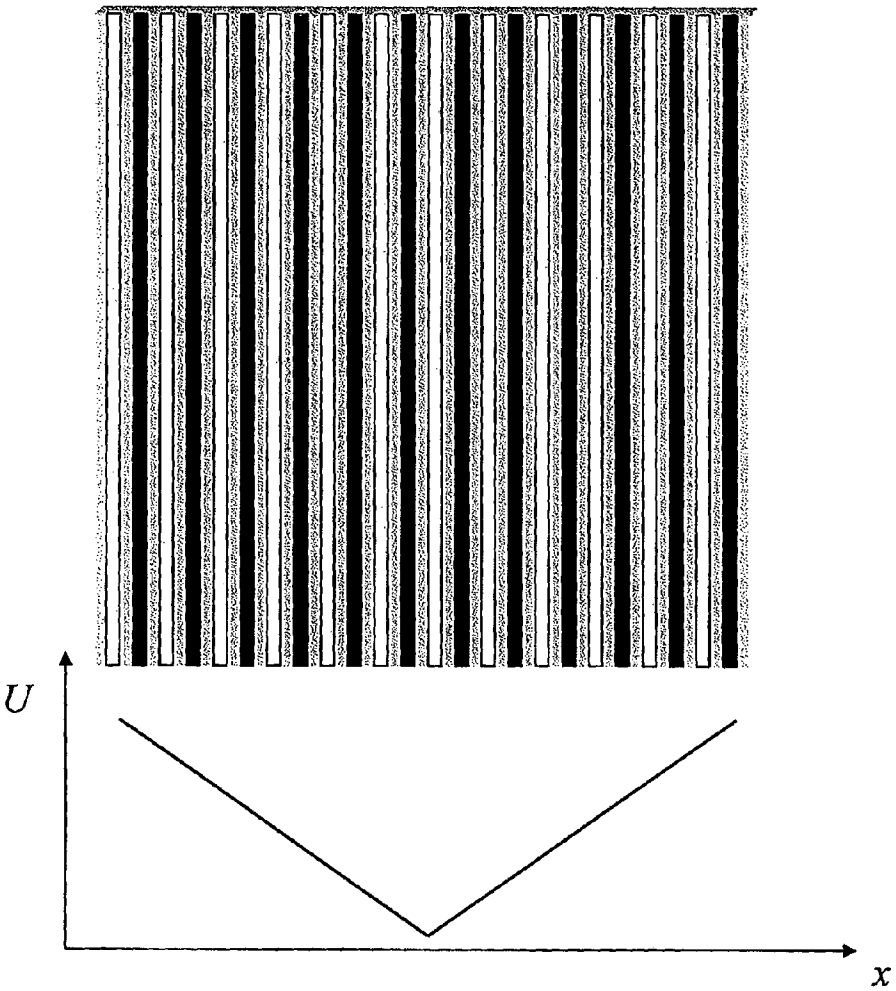
FIG. 20 is a schematic view of a planar ion guide according to various embodiments of the applicant's teachings.
Figure 21:
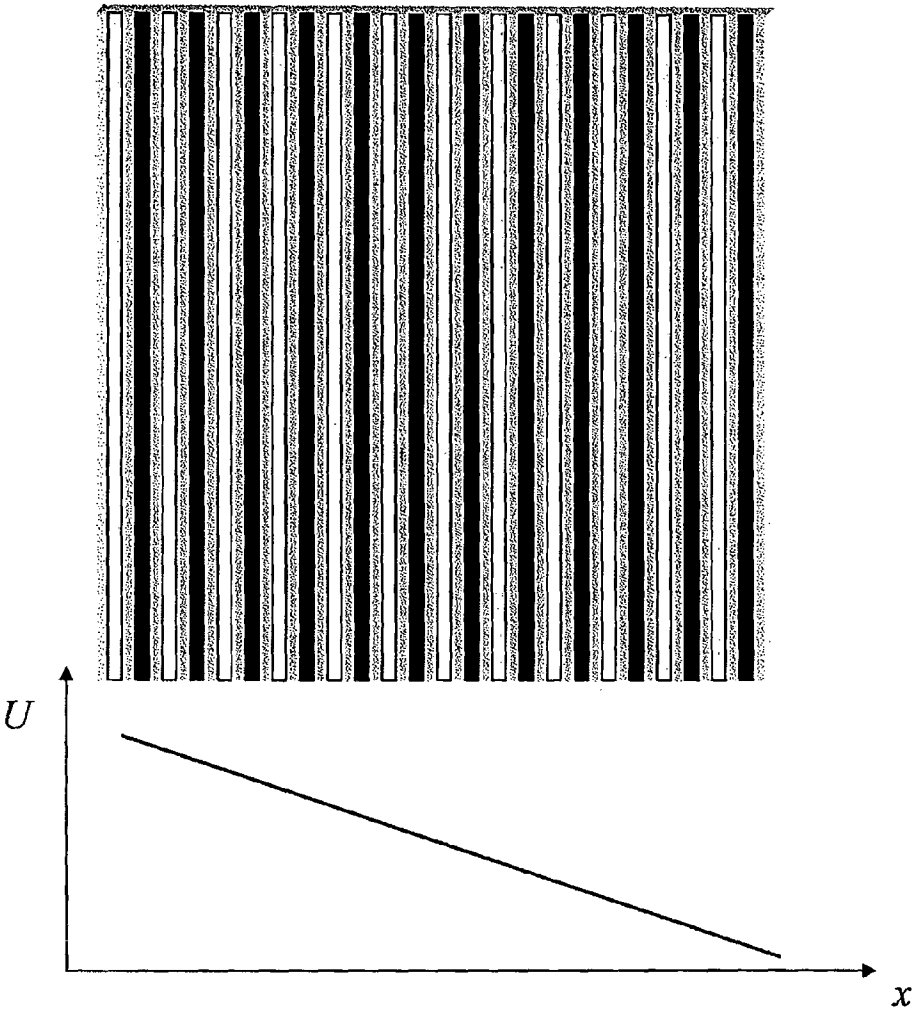
FIG. 21 is a schematic view of a planar ion guide according to various embodiments of the applicant's teachings.

In various aspects, a power supply provides an RF voltage to the array of RF elements wherein adjacent RF elements are each connected to opposite phases of the RF voltage. In various embodiments, multiple phases of RF can be provided. In various aspects, a power supply provides voltage to the array of RF elements for directing the ions towards the second end of the at least one planar RF ion guide. In various embodiments, a power supply can be provided for providing auxiliary voltage to the array of RF elements for directing the ions towards the second end of the at least one planar RF ion guide. Reference is made to FIG. 19 which shows an example of electrical connections. FIG. 20 shows a possible distribution of DC potential leading to ion accumulation in the middle. FIG. 21 shows the distribution of DC potential with ion accumulation towards the edge.

Figure 22:
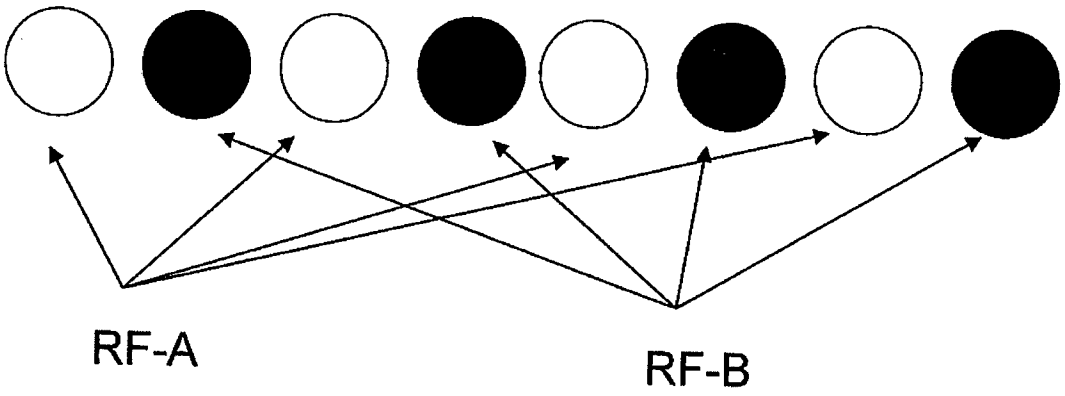
FIG. 22 is a cross-sectional view of a planar ion guide according to various embodiments of the applicant's teachings.
Figure 23:
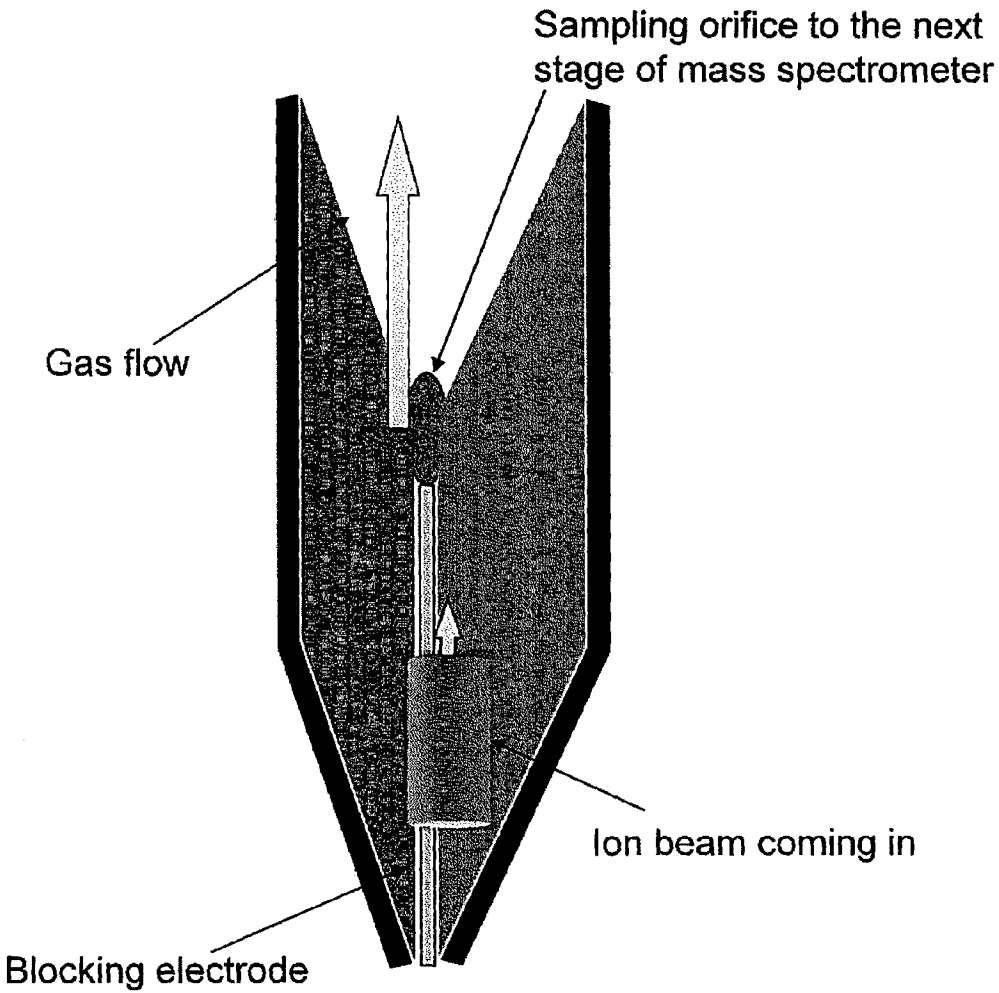
FIG. 23 is a schematic view of a planar ion guide according to various embodiments of the applicant's teachings.
Figure 24:
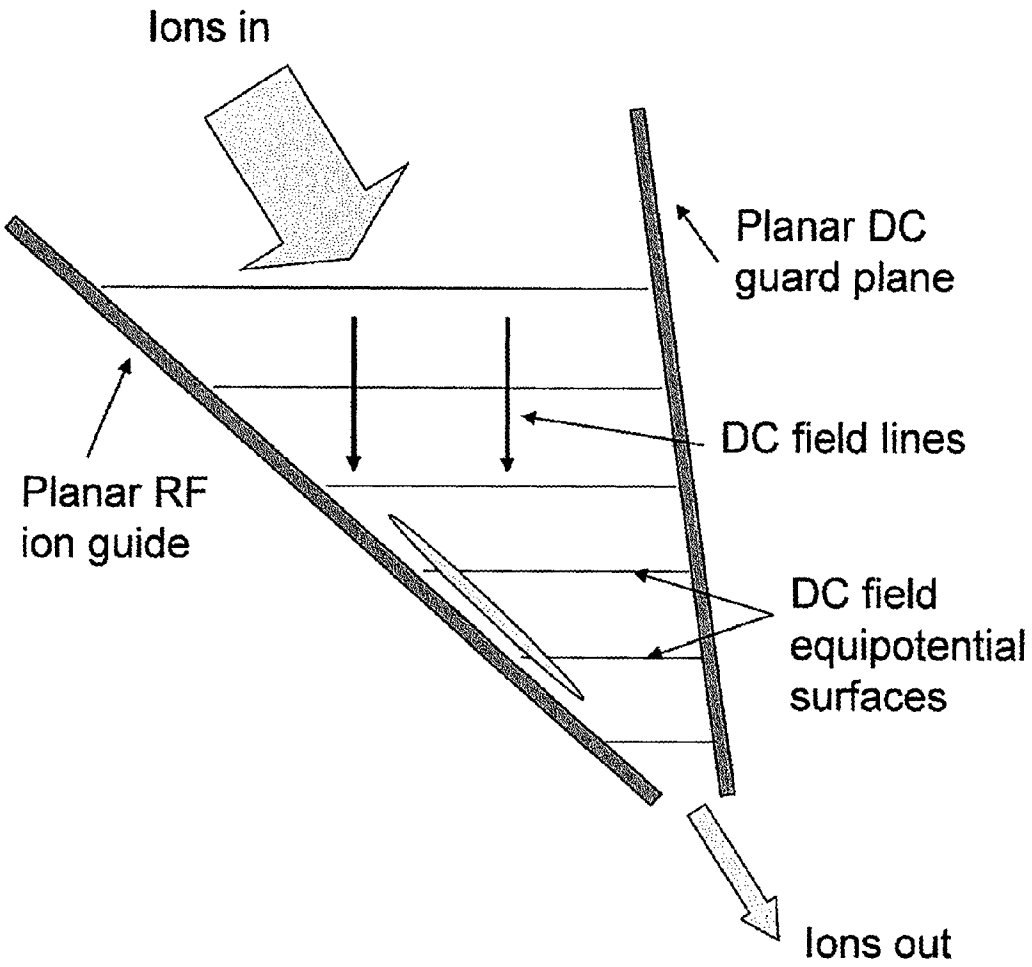
FIG. 24 is a schematic view of a planar ion guide according to various embodiments of the applicant's teachings.
Figure 25:
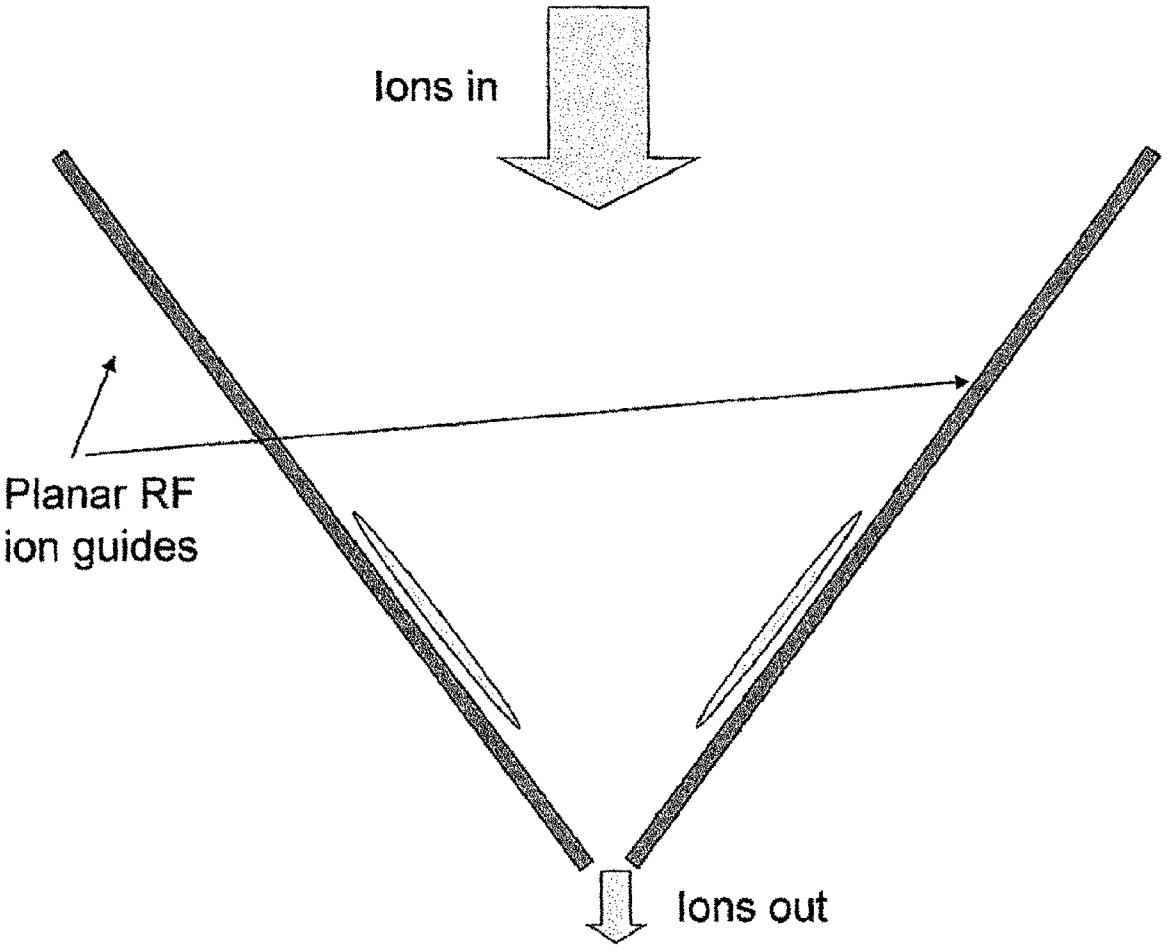
FIG. 25 is a schematic view of a planar ion guide according to various embodiments of the applicant's teachings.
Figure 26:
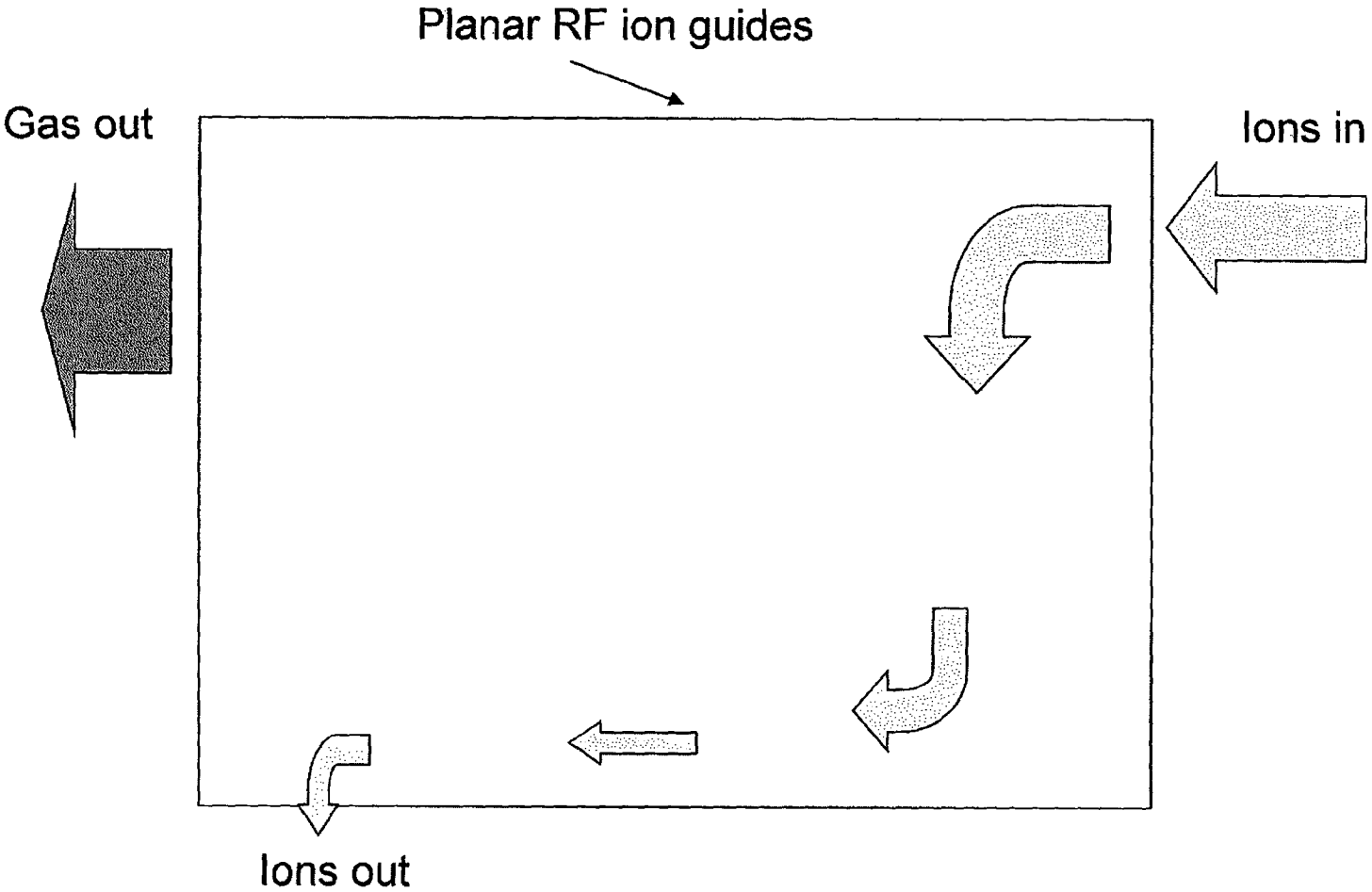
FIG. 26 is a schematic view of a planar ion guide according to various embodiments of the applicant's teachings.
Figure 27:
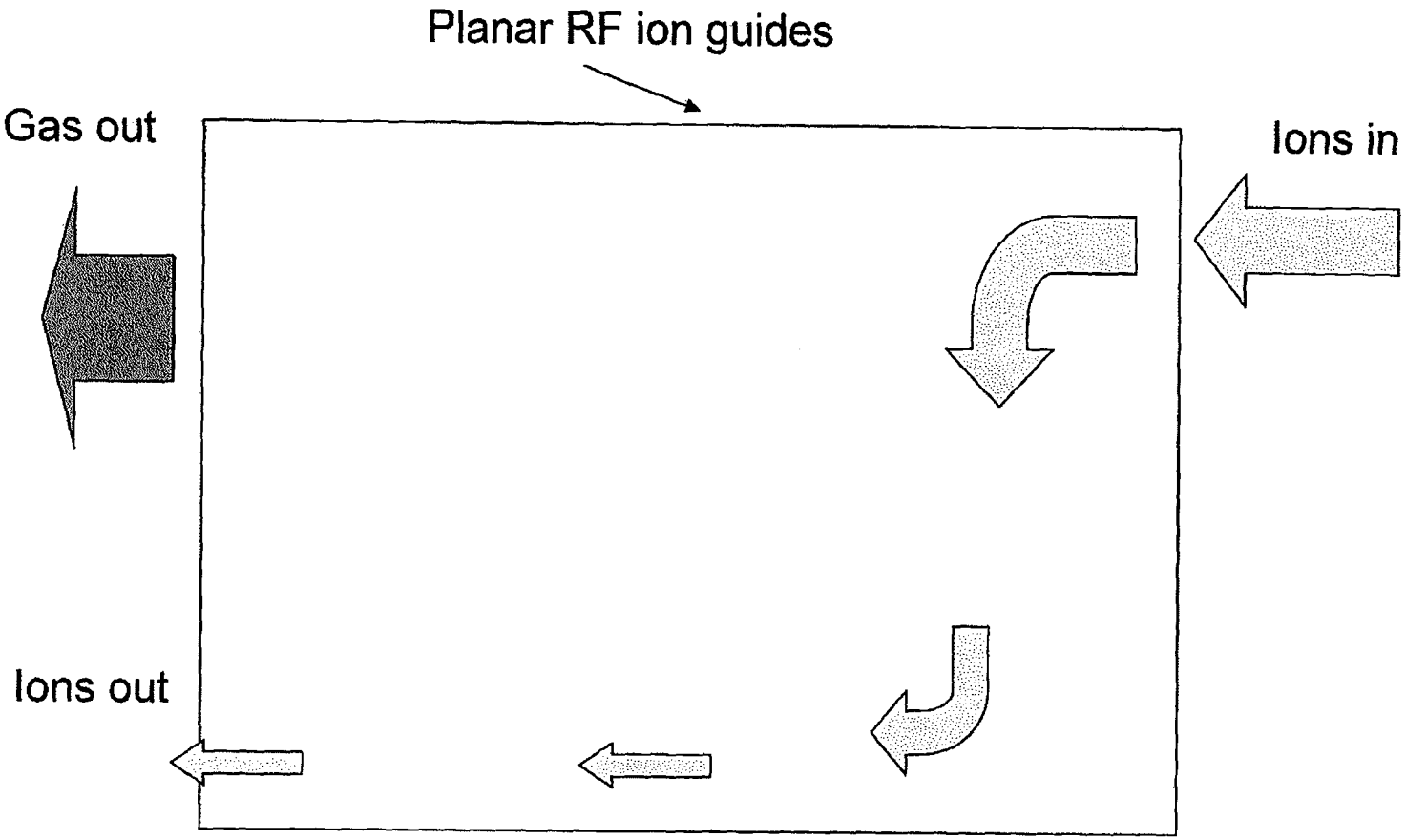
FIG. 27 is a schematic view of a planar ion guide according to various embodiments of the applicant's teachings.
Figure 28:
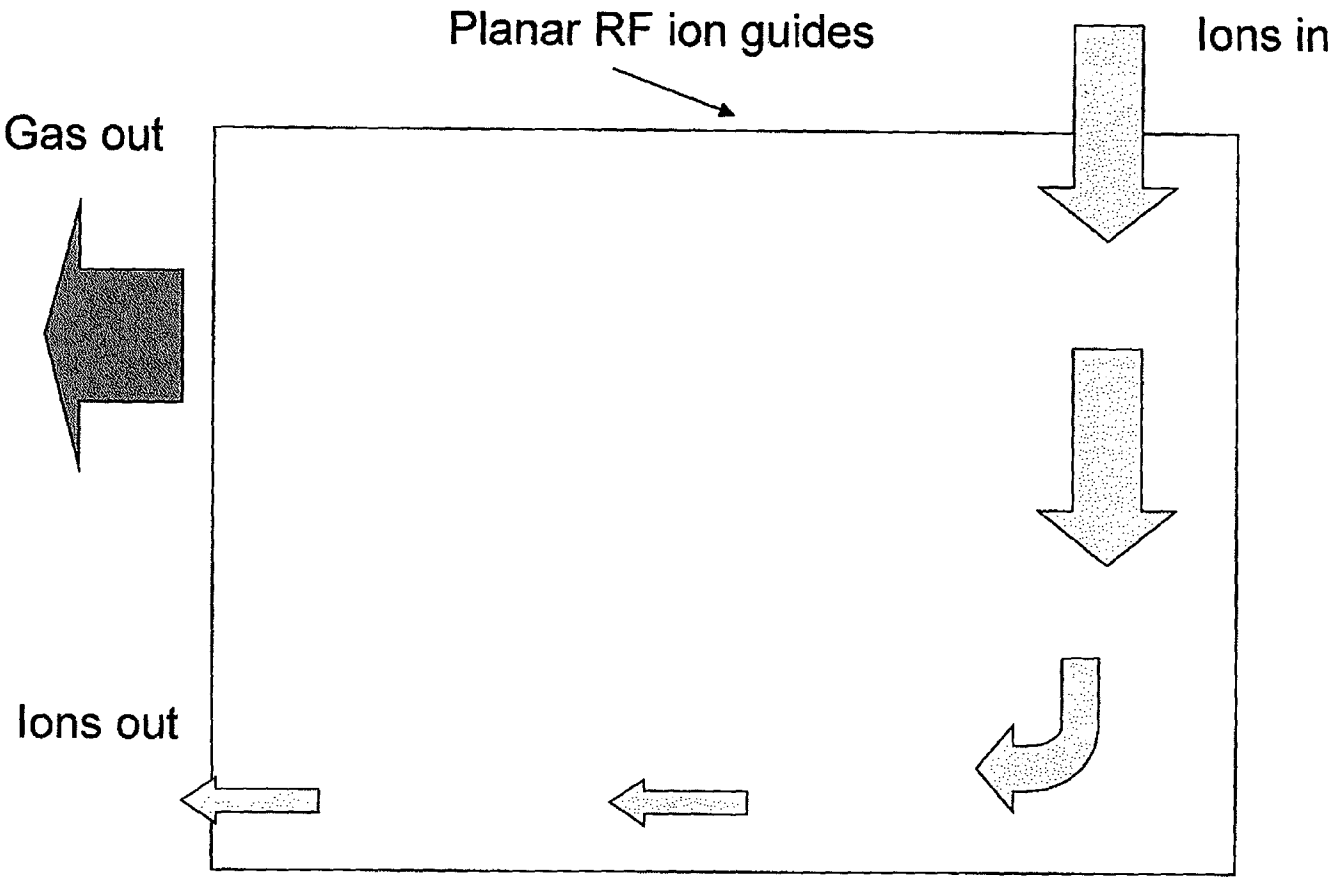
FIG. 28 is a schematic view of a planar ion guide according to various embodiments of the applicant's teachings.
Figure 29:
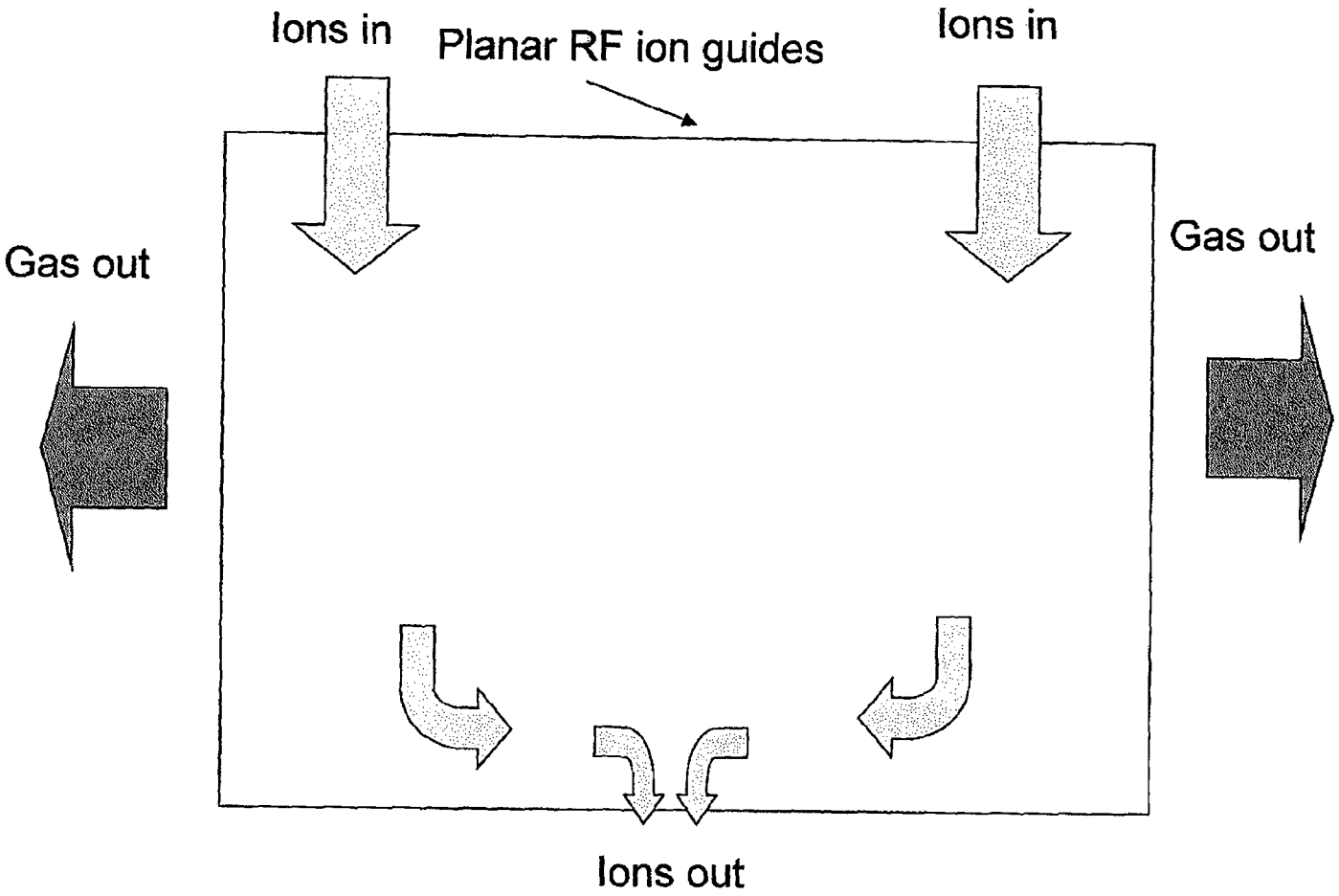
FIG. 29 is a schematic view of a planar ion guide according to various embodiments of the applicant's teachings.

In various embodiments, the at least one planar RF ion guide can comprise a frame with stretched wire electrodes. Reference is made to FIG. 22 which shows a cross-section of a planar ion guide surface made with stretched wires. In various embodiments, the at least one planar RF ion guide can comprise a printed circuit board. In various embodiments, the at least one planar RF ion guide can comprise a first planar RF ion guide and a second planar RF ion guide facing each other as exemplified in FIG. 23. A blocking electrode can be provided at the intersection of the first and second planar RF ion guides. In various embodiments, the at least one planar RF ion guide can comprise a series of planar RF ion guides. FIGS. 24 and 25 show examples of configurations of a first and a second planar RF ion guide according to various embodiments of the applicant's teachings.

FIGS. 26 to 29 show examples of planar RF ion guides according to various embodiments of the applicant's teachings. The ions can enter and exit the planar RF ion guide in various ways as exemplified in FIGS. 26 to 29.

All literature and similar material cited in this application, including, but not limited to, patents, patent applications, articles, books, treatises, and web pages, regardless of the format of such literature and similar materials, are expressly incorporated by reference in their entirety. In the event that one or more of the incorporated literature and similar materials differs from or contradicts this application, including but not limited to defined terms, term usage, described techniques, or the like, this application controls.

While the applicant's teachings have been particularly shown and described with reference to specific illustrative embodiments, it should be understood that various changes in form and detail may be made without departing from the spirit and scope of the teachings. Therefore, all embodiments that come within the scope and spirit of the teachings, and equivalents thereto, are claimed. The descriptions and diagrams of the methods of the applicants' teachings should not be read as limited to the described order of elements unless stated to that effect.

While the applicant's teachings have been described in conjunction with various embodiments and examples, it is not intended that the applicant's teachings be limited to such embodiments or examples. On the contrary, the applicant's teachings encompass various alternatives, modifications, and equivalents, as will be appreciated by those of skill in the art, and all such modifications or variations are believed to be within the sphere and scope of the invention.

The invention claimed is:

1. A mass spectrometer comprising:

an ion source for generating a beam of ions;

an ion guide chamber for receiving the ions from the ion source, the ion source chamber having a gas flow wherein the ions are entrained in the gas flow, the gas flow having a longitudinal velocity and a transverse velocity; the ion guide chamber further comprising an exit aperture for passing the ions from the ion guide chamber;

at least one ion guide located in the ion guide chamber, the at least one ion guide having an entrance end and a predetermined entrance cross-section defining an internal volume;

the at least one ion guide having an exit end and an exit cross-section wherein the exit cross-section is sized to be smaller in area than the entrance cross-section;

a power supply for providing an RF voltage to the at least one ion guide; and the at least one ion guide comprising at least one multipole ion guide having a plurality of elongated electrodes wherein a gap between the elongated electrodes and the shape of the elongated electrodes in the vicinity of the gap are essentially the same along the length of the at least one ion guide for confining the ions in the vicinity of the gap by a combination of the transverse velocity of the gas and the RF voltage.

2. The mass spectrometer of claim 1 wherein the gap between the elongated electrodes comprises between about 0.001 mm and about 5 mm.

3. The mass spectrometer of claim 1 wherein the entrance end of the at least one ion guide is sized to capture the entire ion beam.

4. The mass spectrometer of claim 1 wherein the elongated electrodes comprise a planar portion and wherein the width of the planar portion is reduced to zero towards the exit end of the at least one ion guide, and optionally wherein the length of the elongated electrodes is between about 1 cm to about 300 cm.

5. The mass spectrometer of claim 1 further comprising a mesh covering a planar portion of the elongated electrodes and a gas conduit for providing buffer gas for flowing through the mesh into the ion guide, and optionally wherein the planar portion can comprise one of either a convex and a concave surface.

6. The mass spectrometer of claim 1 further comprising a gas dynamic ion transfer device, and optionally further comprising a gas flow displacement element located towards the exit end of the ion guide.

7. The mass spectrometer of claim 1 wherein the at least one multipole ion guide is selected from a quadrupole ion guide having four elongated electrodes, a hexapole ion guide having six elongated electrodes, an octapole ion guide having eight elongated electrodes, a dodecople having 12 electrodes, an 18-pole ion guide, a 36-pole ion guide, a 54-pole ion guide, a 72-pole ion guide, a 108-pole ion guide, and any combination thereof.

8. The mass spectrometer of claim 1 wherein the at least one ion guide comprises a first ion guide followed by a second ion guide wherein the diameter of the entrance end of the second ion guide is smaller than the diameter of the exit end of the first ion guide, and optionally wherein the diameter of the second ion guide is about 4 mm at an entrance end and about 1 mm at an exit end, and optionally wherein the first and second ion guides are selected from a quadrupole ion guide having four elongated electrodes, a hexapole ion guide having six elongated electrodes, an octapole ion guide having eight elongated electrodes, a dodecople having 12 electrodes, an 18-pole ion guide, a 36-pole ion guide, a 54-pole ion guide, a 72-pole ion guide, a 108-pole ion guide, and any combination thereof.

9. The mass spectrometer of claim 8 wherein the first and second ion guides are in separate differentially pumped vacuum chambers, and optionally wherein a gas dynamic ion transfer device connects the first and second ion guides.

10. The mass spectrometer of claim 1 wherein the at least one ion guide comprises a series of multipole ion guides.

11. The mass spectrometer of claim 1 wherein the ion guide chamber comprises a circular inlet aperture having a diameter between about 0.1 and about 5 mm, optionally wherein the ion guide chamber comprises a circular inlet aperture having a diameter of about 2 mm, and optionally wherein the predetermined cross-section forms an inscribed circle and has a diameter between about 1 and about 15 mm.

12. The mass spectrometer of claim 1 wherein the ion guide chamber has a pressure between about 0.1 and about 100 torr, and optionally wherein the ion guide chamber has a pressure of about 10 torr.

13. A method of transmitting ions comprising:

generating a beam of ions from a sample in a high pressure region;

providing a vacuum chamber comprising an inlet aperture for passing the ions from the high-pressure region into the vacuum chamber, the vacuum chamber having a gas flow wherein the ions are entrained in the gas flow, the gas flow having a longitudinal velocity and a transverse velocity; the vacuum chamber further comprising an exit aperture for passing the ions from the vacuum chamber;

applying an RF voltage to the at least one ion guide; and providing at least one ion guide between the inlet and exit apertures, the at least one ion guide having a predetermined cross-section defining an internal volume; the at least one ion guide having an exit end and an exit cross-section wherein the exit cross-section is sized to be smaller in area than the entrance cross-section; the at least one ion guide comprising at least one multipole ion guide having a plurality of elongated electrodes wherein a gap between the elongated electrodes and the shape of the elongated electrodes in the vicinity of the gap are essentially the same along the length of the at least one ion guide for confining the ions in the vicinity of the gap by a combination of the gas drag due to the transverse velocity of the gas and the RF voltage.

14. The method of claim 13 wherein the gap between the elongated electrodes comprises between about 0.001 mm and about 5 mm, and optionally wherein the entrance end of the at least one ion guide is sized to capture the entire ion beam.

15. The method of claim 13 wherein the elongated electrodes comprise a planar portion and wherein the width of the planar portion is reduced to zero towards the exit end of the at least one ion guide, and optionally wherein the length of the elongated electrodes is between about 1 cm to about 300 cm.

16. The method of claim 13 further comprising a mesh covering a planar portion of the elongated electrodes and a gas conduit for providing buffer gas for flowing through the mesh into the ion guide, and optionally wherein the planar portion can comprise one of either a convex and a concave surface.

17. The method of claim 13 further comprising a gas dynamic ion transfer device, optionally further comprising a gas displacement element located towards the exit end of the ion guide; and optionally wherein the at least one multipole ion guide is selected from a quadrupole ion guide having four elongated electrodes, a hexapole ion guide having six elongated electrodes, an octapole ion guide having eight elongated electrodes, a dodecople having 12 electrodes, an 18-pole ion guide, a 36-pole ion guide, a 54-pole ion guide, a 72-pole ion guide, a 108-pole ion guide, and any combination thereof.

18. The method of claim 13 wherein the at least one ion guide comprises a first ion guide followed by a second ion guide wherein the diameter of the entrance end of the second ion guide is smaller than the diameter of the exit end of the first ion guide, optionally wherein the diameter of the second ion guide is about 4 mm at an entrance end and about 1 mm at an exit end, optionally wherein the first and second ion guides are selected from a quadrupole ion guide having four elongated electrodes, a hexapole ion guide having six elongated electrodes, an octapole ion guide having eight elongated electrodes, a dodecople having 12 electrodes, an 18-pole ion guide, a 36-pole ion guide, a 54-pole ion guide, a 72-pole ion guide, a 108-pole ion guide, and any combination thereof, optionally wherein the first and second ion guides are in separate differentially pumped vacuum chambers, and optionally wherein a gas dynamic ion transfer device connects the first and second ion guides.

19. The method of claim 13 wherein the at least one ion guide comprises a series of multipole ion guides, optionally wherein the inlet aperture is circular and has a diameter between about 0.1 and about 5 mm, optionally wherein the circular inlet aperture comprises a diameter of about 2 mm, and optionally wherein the predetermined cross-section forms an inscribed circle and has a diameter between about 1 and about 15 mm.

20. The method of claim 13 wherein the vacuum chamber has a pressure between about 0.1 and about 100 torr, and optionally wherein the vacuum chamber has a pressure of about 10 torr.

* * * * *